US011993476B2

(12) United States Patent
Osada et al.

(10) Patent No.: US 11,993,476 B2
(45) Date of Patent: May 28, 2024

(54) SHEET PROCESSING APPARATUS AND IMAGE FORMING SYSTEM HAVING THE SAME

(71) Applicants: Toshiki Osada, Yamanashi (JP); Natsuki Shimizu, Yamanashi (JP)

(72) Inventors: Toshiki Osada, Yamanashi (JP); Natsuki Shimizu, Yamanashi (JP)

(73) Assignee: CANON FINETECH NISCA INC., Misato (JP)

( * ) Notice: Subject to any disclaimer, the term of this patent is extended or adjusted under 35 U.S.C. 154(b) by 342 days.

(21) Appl. No.: 17/552,716

(22) Filed: Dec. 16, 2021

(65) Prior Publication Data

US 2022/0185612 A1 Jun. 16, 2022

(30) Foreign Application Priority Data

Dec. 16, 2020 (JP) ..... 2020-208389
Dec. 16, 2020 (JP) ..... 2020-208390

(51) Int. Cl.
*B65H 33/08* (2006.01)
*B65H 37/04* (2006.01)
*B65H 43/06* (2006.01)

(52) U.S. Cl.
CPC ..... *B65H 37/04* (2013.01); *B65H 43/06* (2013.01); *B65H 33/08* (2013.01); *B65H 2301/4212* (2013.01)

(58) Field of Classification Search
CPC ..... B65H 37/04; B65H 43/06; B65H 31/38; B65H 33/08
See application file for complete search history.

(56) References Cited

U.S. PATENT DOCUMENTS

| | | | | |
|---|---|---|---|---|
| 8,136,807 | B2 * | 3/2012 | Uchiyama | B65H 31/10 270/58.11 |
| 8,864,129 | B2 * | 10/2014 | Fukuda | B65H 31/24 271/223 |
| 9,334,139 | B2 * | 5/2016 | Hongu | B65H 31/3081 |
| 9,415,966 | B2 * | 8/2016 | Nishi | B65H 31/3063 |
| 9,944,488 | B2 * | 4/2018 | Kunieda | B65H 31/02 |
| 10,947,077 | B2 * | 3/2021 | Taki | B65H 31/36 |
| 11,249,432 | B2 * | 2/2022 | Komiyama | B65H 31/10 |
| 11,427,428 | B2 * | 8/2022 | Furumido | B65H 33/08 |
| 11,518,642 | B2 * | 12/2022 | Shimizu | B65H 37/04 |
| 11,713,206 | B2 * | 8/2023 | Yanagisawa | B65H 31/36 271/258.01 |
| 2017/0240377 | A1 * | 8/2017 | Moriya | B65H 31/34 |
| 2017/0283208 | A1 * | 10/2017 | Matsuki | B31F 5/001 |

FOREIGN PATENT DOCUMENTS

| | | | |
|---|---|---|---|
| JP | 2015-20823 | A | 2/2015 |
| JP | 6238614 | B2 | 11/2017 |

* cited by examiner

*Primary Examiner* — Howard J Sanders
(74) *Attorney, Agent, or Firm* — HAUPTMAN HAM, LLP

(57) ABSTRACT

At the point in time when it is determined that the number of sheets constituting one sheet bundle exceeds the maximum number of sheets that can be crimp-bound, a sheet bundle that has already been shifted to a crimp-binding position is discharged to a crimp-binding discharge position without being subjected to crimp-binding. Thereafter, succeeding sheets are shifted as a bundle to the crimp-binding position and discharged to the crimp-binding discharge position without being subjected to crimp-binding.

13 Claims, 24 Drawing Sheets

SHEET PROCESSING APPARATUS AND IMAGE FORMING SYSTEM HAVING THE SAME

TECHNICAL FIELD

The present invention relates to the improvement of a sheet processing apparatus that applies predetermined processing to sheets after stacking and shifting the sheets.

BACKGROUND ART

There is generally widely known a post-processing apparatus (finisher) that collates and stacks sheets on which images have been formed by an image forming apparatus on a processing tray and binds the sheets. The sheet binding can be performed by, for example, a stapler device that binds sheets with staples and a crimp-binding device that applies pressure to stacked sheets and deforms them for binding.

Patent Document 1 discloses an apparatus that is disposed to be connected to a sheet discharge port of an image forming apparatus and is configured to receive image-formed sheets along a carry-in path, stack the sheets on a processing tray, bind the sheets on the processing tray by means of a crimp-binding device, and store the resultant sheet bundle on a stack tray arranged on the downstream side. The crimp-binding device disclosed in the same document is configured to perform crimp-binding after regulating the sheets that have been fed to the processing tray along a sheet discharge path and stacked while being subjected to abutment regulation at the rear end portion thereof in the sheet discharge direction for positioning, aligning the sheet bundle in a sheet width direction, shifting the sheet bundle in the width direction, thus causing less misalignment in the sheet bundle.

Further, Patent Document 2 discloses an apparatus configured to discharge a sheet bundle in a number exceeding the maximum number of sheets that can be crimp-bound by a crimp-binding unit to a discharge position different from a crimp-binding discharge position.

PRIOR ART DOCUMENT

Patent Document

Patent Document 1: Japanese Patent Application Laid-Open No. 2015-020823

Patent Document 2: Japanese Patent No. 6238614

DISCLOSURE OF INVENTION

Problems to be Solved by the Invention

The maximum number of sheets that can be crimp-bound has recently been increased. Under such a circumstance, there is a need to perform bundle shift to a crimp-binding unit a plurality of times so as not for the number of sheets constituting one sheet bundle to exceed the maximum number of sheets that can be shifted as a bundle. Therefore, in a case where the maximum number of sheets that can be crimp-bound exceeds the maximum number of sheets that can be shifted as a bundle (bundle shift is performed a plurality of times for one sheet bundle) and where the number of sheets constituting one sheet bundle exceeds the number of sheets that can be crimp-bound, a sheet bundle that has already been shifted to the crimp-binding unit cannot be discharged to a position different from the crimp-binding position since the number of sheets constituting this sheet bundle exceeds the maximum number of sheets that can be shifted as a bundle. Therefore, this sheet bundle is discharged to a crimp-binding discharge position, and succeeding sheets are not shifted as a bundle to the crimp-binding unit but are discharged to a position other than the crimp-binding discharge position since it is clear at this point in time that the maximum number of sheets that can be crimp-bound is exceeded. This disadvantageously causes sheets constituting one sheet bundle to be discharged to a plurality of different positions.

The present invention has been made in view of the problem of conventional techniques, and an object thereof is to provide a sheet processing apparatus in which sheets constituting one sheet bundle are prevented from being discharged to different positions when the number of sheets constituting one sheet bundle exceeds the maximum number of sheets that can be crimp-bound.

Means for Solving the Problem

A sheet processing apparatus according to the present invention includes: a conveying unit that conveys a sheet in a predetermined direction; a placing part on which the sheet conveyed by the conveying unit is stacked; a non-stapling unit that performs binding processing for the sheet without using a staple; a bundle shift unit engaged with end edges of the sheet stacked on the placing part that are parallel to the conveying direction and configured to move the sheet in a direction perpendicular to the conveying direction to a non-staple binding position at which the non-stapling unit performs the binding processing; a discharge unit that discharges the sheet from the placing part; a stacking part on which the sheet discharged by the discharge unit is stacked; a number-of-sheets recognizing unit that recognizes the number of sheets stacked on the placing part; and a controller that controls the bundle shift unit and the discharge unit. When moving the sheets stacked on the placing part to the non-staple binding position, the controller controls the bundle shift unit and the discharge unit such that: at the point in time when the number-of-sheets recognizing unit recognizes that the number of sheets to be stacked on the placing part exceeds a predetermined number of sheets, the sheets that have already been moved to the non-staple binding position are discharged to the stacking part by the discharge unit; and succeeding sheets constituting a sheet bundle together with the sheets that have already been moved to the non-staple binding position shift position are stacked on the placing part, moved to the non-staple binding position by the bundle shift unit, and discharged onto the stacking part by the discharge unit.

Advantageous Effect of the Invention

According to the present invention, at the point in time when it is determined that the number of sheets constituting one sheet bundle exceeds the maximum number of sheets that can be crimp-bound, a sheet bundle that has already been shifted to a crimp-binding position is discharged to a crimp-binding discharge position without being subjected to crimp-binding. Thereafter, succeeding sheets are shifted as a bundle to the crimp-binding position and discharged to the crimp-binding discharge position without being subjected to crimp-binding. This prevents sheets constituting one sheet bundle from being discharged to different positions.

BRIEF DESCRIPTION OF DRAWINGS

FIGS. 9A and 9B are explanatory views illustrating a binding unit according to the present invention, in which FIG. 9A illustrates the configuration of a stapling unit, and FIG. 9B illustrates the configuration of an eco-binding unit;

MODE FOR CARRYING OUT THE INVENTION

In this specification, "offset conveyance of a sheet bundle" refers to moving (widthwise moving) a sheet bundle carried in through a sheet discharge port in a direction perpendicular to (or intersecting with) a sheet conveying direction, and "offset amount" refers to a movement amount thereof. Further, "alignment of a sheet bundle" refers to aligning sheets having different sizes carried in through a sheet discharge port in accordance with reference (in center reference or side reference). Thus, "offset after sheet alignment" refers to moving the whole sheets in a direction perpendicular to the sheet conveying direction after the sheets having different sizes are aligned to the reference. Further, the term "perpendicular" includes not only a case where two elements intersect each other at exactly 90° but also a case where they intersect each other at about 90° and a case where they substantially or roughly intersect each other.

The center reference and center position used herein refer to the center as a reference position for sheet conveyance and may differ from the dimensional center of the apparatus. Further, the center position of a placing part to be described later refers to a position to which a sheet conveyed in the conveying direction is discharged and may differ from the dimensional center of the placing part.

[Image Forming System]

Figure 1:
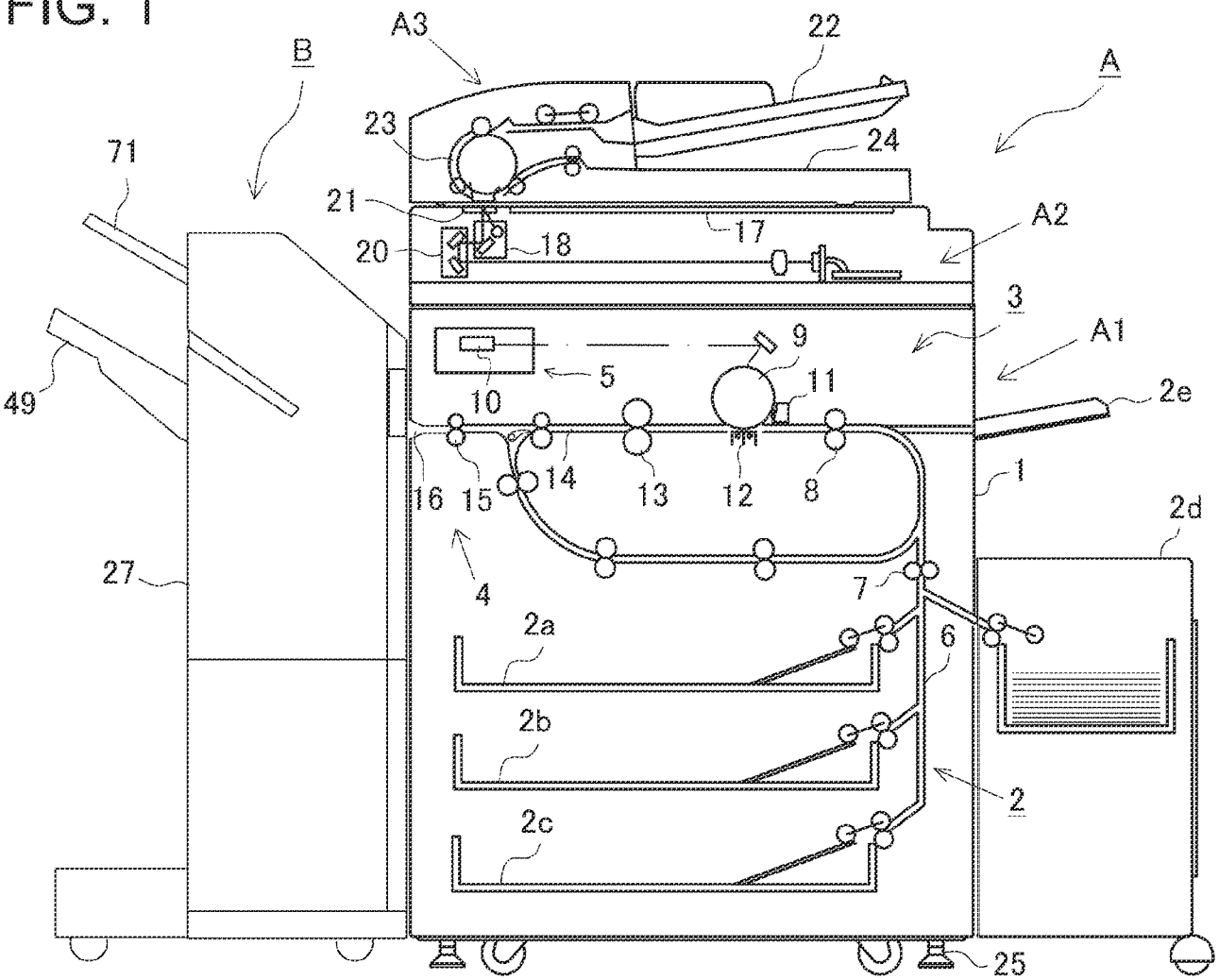
FIG. 1 is an explanatory view illustrating the entire configuration of an image forming system according to the present invention.

Hereinafter, the present invention will be described in detail based on illustrated preferred embodiments. The present invention relates to a sheet post-processing apparatus B that applies binding processing, folding processing, and other post-processing to sheets image-formed by an image forming apparatus A and an image forming system having the sheet post-processing apparatus B, as illustrated in FIG. 1.

The image forming apparatus A forms an image on a sheet based on image data transferred from image reading devices such as a copier, a facsimile device or a printer, or an external device. That is, the image forming apparatus A serves as an image forming part for an output terminal of a computer network, a copier system or a facsimile system and has a configuration (stand-alone configuration) that forms an image on a sheet based on data read by an image reading part provided in the system or a configuration (network configuration) that forms an image on a sheet based on image data created or read within a computer network. The following describes the image forming apparatus A and sheet post-processing apparatus B in this order according to FIG. 1 illustrating the network configuration.

[Image Forming Apparatus]

The image forming apparatus A in the image forming system illustrated in FIG. 1 will be described. The illustrated image forming apparatus A is configured as an electrostatic printing mechanism and includes an image forming unit A1, a scanner unit A2, and a feeder unit A3. An apparatus housing 1 has mounting legs 25 placed on an installation surface (e.g., a floor surface). The apparatus housing 1 incorporates a sheet feed part 2, an image forming part 3, a sheet discharge part 4, and a data processing part 5.

The sheet feed part 2 includes a cassette mechanism for storing sheets of a different sizes on which images are formed and delivers sheets of the size designated by a main body controller 90 to a sheet feed path 6. The cassette mechanism detachably includes a plurality of cassettes 2*a* to 2*c* each of which incorporates a separating mechanism to separate sheets in the cassette one from another and a sheet feed mechanism to deliver the sheet. The sheet feed path 6 is provided with a conveying roller 7 for feeding a sheet fed from the plurality of cassettes 2*a* to 2*c* to the downstream side. Further, a registration roller pair 8 is provided at the end of the sheet feed path 6 and aligns the front ends of the sheets fed thereto.

The above sheet feed path 6 is connected with a large capacity cassette 2*d* and a manual feed tray 2*e*. The large capacity cassette 2*d* is constituted by an option unit for storing sheets of a size to be consumed in a large amount. The manual feed tray 2*e* is configured to feed thick sheets which are difficult to separate upon feeding and special sheets such as coated sheets and film sheets.

The image forming part 3 represents an electrostatic printing mechanism and has a photoreceptor 9 (drum or belt) and an emitter 10 for emitting optical beam toward the photoreceptor 9, a developing unit (developer) 11, and a cleaner (not illustrated) which are disposed around the rotating photoreceptor 9. The illustrated image forming part 3 is a monochrome printing mechanism and configured to optically form a latent image on the photoreceptor 9 using the emitter 10 and to attach toner ink to the latent image using the developing unit 11.

A sheet is fed along the sheet feed path 6 to the image forming part 3 at the timing of image formation on the photoreceptor 9, and the image is transferred onto the sheet using a transfer charger 12. The transferred image is then subjected to fixing by a fixing unit (roller) 13 disposed in a sheet discharge path 14. The sheet discharge path 14 is provided with a sheet discharge roller 15 and a sheet discharge port 16, and the sheet is conveyed by the sheet discharge roller 15 to the sheet post-processing apparatus B to be described later, through the sheet discharge port 16.

The scanner unit A2 includes a platen 17 on which an image document is placed, a carriage 18 that reciprocates along the platen 17, a photoelectric conversion unit 19, and a reduction optical system 20 (a combination of a mirror and a lens) that guides light from a light source mounted on the carriage 18 and light reflected from the document on the platen 17 to the photoelectric conversion unit 19. A reference numeral 21 denotes a second platen (document-traveling platen) that reads an image on a sheet fed from the feeder unit A3 using the carriage 18 and reduction optical system 20. The photoelectric conversion unit 19 electrically transfers image data obtained through photoelectric conversion to the image forming part 3.

The feeder unit A3 includes a sheet feed tray 22, a sheet feed path 23 that guides the sheet fed from the sheet feed tray 22 to the platen 21, and a sheet discharge tray 24 that stores the document sheet image-read by the platen 21.

The image forming apparatus A is not limited to the abovementioned mechanism and may employ printing mechanisms such as an offset printing mechanism, an inkjet printing mechanism, and an ink ribbon transfer printing mechanism (thermal transfer ribbon printing, sublimation ribbon printing, etc.).

[Sheet Post-Processing Apparatus]

The sheet post-processing apparatus B, which is configured to apply post-processing to a sheet carried out from the image forming apparatus A through the sheet discharge port 16, has the following functions: (1) a function of storing image-formed sheets in a stacking manner (first and third processing parts B1 and B3; printout mode); (2) a function of sorting and storing image-formed sheets (third processing part B3; jog sorting mode); (3) a function of collating, stacking, and binding image-formed sheets (first processing part B1; binding processing mode); and (4) a function of collating, binding, and folding (second processing part B2; bookbinding mode) image-formed sheets for bookbinding.

In the present invention, the sheet post-processing apparatus B is not necessarily required to have all the abovementioned functions and may be appropriately arranged in accordance with apparatus specifications (design specifications). Even in this case, the sheet post-processing apparatus B includes at least a processing part (first processing part B1) that collates and stores sheets, a first binding unit (stable binding unit 47 to be described later) provided in the processing part and having higher processing performance in terms of the number of sheets to be processed, a second binding unit (non-staple binding unit 51 to be described later) provided in the processing part and having lower processing performance in terms of the number of sheets to be processed than the first binding unit, and a stack configuration for storing the sheets that have been bound by a selected binding unit.

Figure 2:
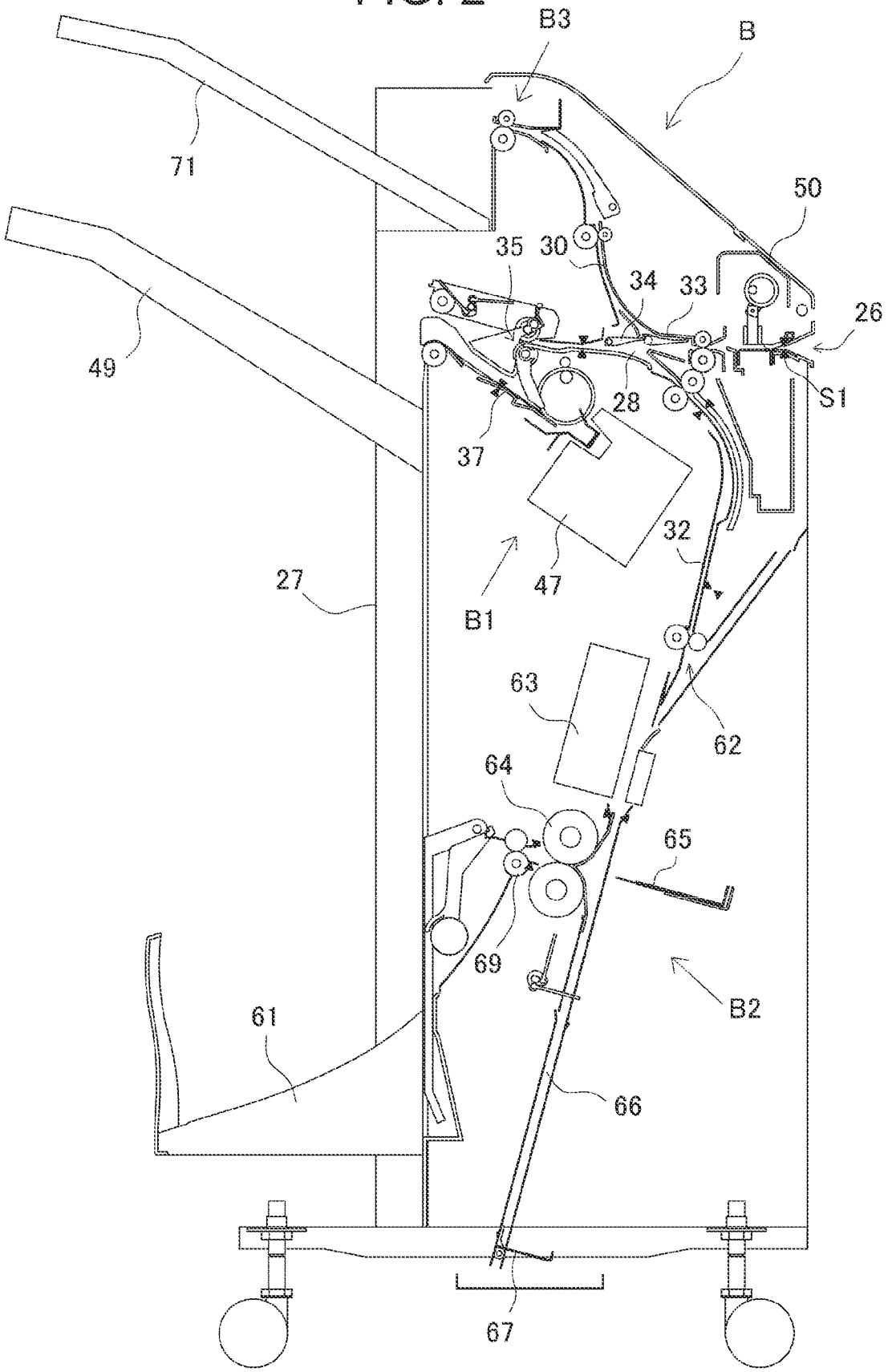
FIG. 2 is an explanatory view illustrating the entire configuration of a post-processing apparatus in the image forming system of FIG. 1.

FIG. 2 illustrates in detail the configuration of the sheet post-processing apparatus B. The sheet post-processing apparatus B has a carry-in port 26 connected to the sheet discharge port 16 of the image forming apparatus A. The sheets carried in through the carry-in port 26 are subjected to post-processing and are then stored in a storing part (first stack tray 49, second stack tray 61, and third stack tray 71 which are to be described later). In the illustrated apparatus, the sheets fed to a sheet carry-in path 28 are transferred from the first processing part B1 to the first stack tray 49 (hereinafter, referred to as "first tray" or "stacking part"), from the second processing part B2 to the second stack tray 61 (hereinafter, referred to as "second tray"), and from the third processing part B3 to the third stack tray 71 (hereinafter, referred to as "third tray").

The first processing part B1 is disposed at a path exit (sheet discharge port) 35 of the sheet carry-in path 28 and collates and stacks sequentially fed sheets, applies binding, and stores the resultant sheets on the first stack tray (first storing part) 49. The second processing part B2 is disposed at a path exit 62 (second switchback path end to be described later) branching from the sheet carry-in path 28 and collates and stacks sequentially fed sheets, applies binding and folding, and stores the resultant sheets on the second stack tray (second storing part) 61. The third processing part B3 is incorporated in the sheet carry-in path 28 and offsets a conveyed sheet by a predetermined amount in the perpendicular direction for sorting and stores the resultant sheet on the third stack tray (third storing part) 71. The respective components will be described in detail below.

[Apparatus Housing]

As illustrated in FIG. 2, the sheet post-processing apparatus B has an apparatus housing 27, a sheet carry-in path 28 incorporated in the apparatus housing 27 and having a carry-in port 26 and a sheet discharge port 35, first to third processing parts B1 to B3 that apply post-processing to sheets fed along the sheet carry-in path 28, and first to third trays 49, 61, and 71 for storing sheets fed from the respective first to third processing parts B1, B2, and B3. The illustrated apparatus housing 27 and the housing 1 of the image forming apparatus A provided on the upstream side relative to the housing 27 have substantially the same height, and the sheet discharge port 16 of the image forming apparatus A and the carry-in port 26 of the sheet post-processing apparatus B are connected to each other.

[Sheet Carry-In Path (Conveying Path)]

The sheet carry-in path 28 is constituted by a linear path that substantially horizontally traverses the apparatus housing 27 and has the carry-in port 26 connected to the sheet discharge port (main body sheet discharge port) 16 of the image forming apparatus A and the sheet discharge port 35 positioned at the end thereof opposite to the carry-in port 26. The sheet carry-in path 28 further has a conveying roller 29 (sheet conveying unit such as a roller or a belt) for conveying a sheet from the carry-in port 26 toward the sheet discharge port 35, a sheet discharge roller 36 (or belt) disposed at the sheet discharge port 35, an entrance sensor S1 for detecting the front and rear ends of the sheet carried in to the path, and a sheet discharge sensor S2 for detecting the front and rear ends of the sheet at the sheet discharge port 35.

The sheet carry-in path 28 is connected to the first processing part B1 and second processing part B2 provided respectively on the downstream and upstream sides in the sheet discharge direction, so as to distribute the sheet received from the carry-in port 26 to the first and second processing parts B1 and B2. The substantially linear-shaped sheet carry-in path 28 is arranged so as to branch to guide the sheet from the carry-in port 26 toward the second processing part B2 and then toward the second processing part B2 located in a downstream position from the sheet discharge port 35.

The sheet carry-in path 28 is further connected to a third sheet discharge path (printout discharge path) 30 for guiding a sheet that is not subjected to post-processing in the first and second processing parts B1 and B2 to the third tray (overflow tray) 71. The sheet carry-in path 28 incorporates the third processing part B3 which is configured to perform jog sorting to offset the sheets conveyed along the path in the sheet discharge perpendicular direction for sorting. That is, the sheet carry-in path 28 incorporates the third processing part B3, and the sheets that have been subjected to jog sorting are stored on the third tray 71.

As illustrated in FIG. 2, the sheet carry-in path 28 includes a third sheet discharge path 30, a second sheet discharge path 32, and a first sheet discharge path 31 in this order from the carry-in port 26 toward the downstream side, and a first path switch unit 33 and a second path switch unit 34 are disposed at the illustrated positions. The second sheet discharge path 32 and first sheet discharge path 31 constitute a switchback path for reversing the sheet conveying direction to guide the sheet to a target processing part.

The third sheet discharge path 30 guides the sheets fed from the carry-in port 26 to the third tray 71, the second sheet discharge path 32 guides the sheets fed from the carry-in port 26 to the second tray 61, and the first sheet discharge path 31 guides the sheets fed from the carry-in port 26 to the first tray 49. The sheets to be guided to the third tray 71 are subjected to jog sorting in the third processing part B3 incorporated in the sheet carry-in path 28, the sheets to be guided to the second tray 61 are subjected to bookbinding processing in the second processing part B2, and the sheets to be guided to the first tray 49 are subjected to binding processing in the first processing part B1.

The first path switch unit 33 is constituted by a flapper guide that changes the sheet conveying direction and is connected to a not-shown drive unit (electromagnetic solenoid, mini motor, etc.). The first path switch unit 33 is used to select whether to guide the sheets from the carry-in port 26 to the third sheet discharge path 30 or the side of the first and second sheet discharge paths 31 and 32. Further, the second path switch unit 34 is used to select whether to guide the sheets from the carry-in port 26 to the second processing part B2 or the first processing part B1 arranged downstream relative to the second processing part B2. The second path switch unit 34 is also connected to a not-shown drive unit. The sheet carry-in path 28 is further provided with a punch unit 50 that punches a hole in the carried-in sheets.

[First Processing Part (Placing Part)]

The first processing part B1 includes a processing tray 37 disposed on the downstream side of the sheet carry-in path 28 and configured to collate and stack the sheets fed from the sheet discharge port 35 and a binding processing mechanism for binding the stacked sheets. As illustrated in FIG. 2, the processing tray 37 is disposed below the sheet discharge port 35 of the sheet carry-in path 28 with a level difference therefrom, and a first sheet discharge path (switchback path) 31 is formed between the sheet discharge port 35 and the processing tray 37 so as to guide the sheets from the sheet discharge port 35 onto the tray by reversing the conveying direction.

A sheet carry-in mechanism for carrying-in the sheets from the sheet discharge port 35 onto the processing tray 37 is disposed between the sheet discharge port 35 and the processing tray 37. The processing tray 37 includes a positioning mechanism for positioning the sheets at a predetermined binding position and a sheet bundle carry-out mechanism for carrying out a sheet bundle obtained by binding processing to the downstream side first tray 49. The respective mechanisms will be described in detail later.

The processing tray 37 illustrated in FIG. 2 bridge-supports the sheets fed from the sheet discharge port 35 with the first tray 49 located downstream relative to the processing tray 37. That is, the sheet fed from the sheet discharge port 35 is bridge-supported such that the front end thereof is on the uppermost sheet on the first tray 49 located downstream and the rear end thereof on the processing tray 37.

[Second Processing Part]

The sheet carry-in path 28 is connected in a branching manner with a second sheet discharge path (second switchback path) 32 arranged on the upstream side relative to the first sheet discharge path (first switchback path) 31. The sheet is guided along the second sheet discharge path 32 to the second processing part B2. The second processing part B2 collates and stacks the sheets fed along the sheet carry-in path 28, binds the sheets at the center portion, and applies inward fold processing (hereinafter, referred to as "magazine finishing"). The second tray 61 is disposed downstream from the second processing part B2 to store a bookbinding-processed sheet bundle.

The second processing part B2 includes a guide member 66 for stacking sheets in a bundle, a regulating stopper (in the drawing, a front end regulating stopper) 67 for positioning sheets at a predetermined position on the guide member 66, a stapling unit (center-binding stapling unit) 63 for performing binding processing at the center portion of the sheets positioned by the regulating stopper 67, and a fold processing mechanism (a pair of fold rollers 64 and a fold blade 65) for folding a sheet bundle at the center portion after the binding processing.

As disclosed in Japanese Patent Application Laid-Open No. 2008-184324, Japanese Patent Application Laid-Open No. 2009-051644 and the like, the center-binding stapling unit 63 employs a mechanism that performs binding processing while moving a sheet bundle along the sheet center portion (line) with the sheet bundle nipped by a head unit and an anvil unit. Further, as illustrated in FIG. 2, the fold processing mechanism has a configuration to perform folding by rolling of the fold roller pair 64 after a fold line of a sheet bundle is inserted by the fold blade 65 between the pair of fold rollers 64 in a pressure contact state. Such a mechanism is also disclosed in Japanese Patent Application Laid-Open No. 2008-184324, Japanese Patent Application Laid-Open No. 2009-051644 and the like.

The illustrated first processing part B1 and sheet carry-in path 28 are arranged substantially in the horizontal direction, the second sheet discharge path 32 for guiding sheets to the second processing part B2 is arranged in the vertical direction, and the guide member 66 for collating and stacking sheets is arranged substantially in the vertical direction. As described above, the sheet carry-in path 28 is arranged in a direction traversing the apparatus housing 27, and the processing paths (parts) 32 and B2 are arranged in the vertical direction, so that the apparatus can be slimmed down.

The second tray 61 is disposed on the downstream location of the second processing part B2 to store a sheet bundle that has been folded into a magazine shape. The illustrated second tray 61 is disposed below the first tray 49. In view of that a frequency in use of the first tray 49 is higher than a frequency in use of the second tray 61, the first tray 49 is disposed at a height position at which sheets are easily taken out.

[Third Processing Part]

The third sheet discharge path 30 is formed in the sheet carry-in path 28 upstream relative to the first sheet discharge path 31 and second sheet discharge path 32 so as to guide a sheet from the carry-in port 26 to the third tray 71. Further, a roller shift mechanism (not illustrated) for offsetting a conveyed sheet by a predetermined amount in the direction perpendicular to the conveying direction is disposed in the path (carry-in path 28 or third sheet discharge path 30) for guiding the sheet from the carry-in port 26 to the third tray 71.

Then, the sheets to be discharged from the carry-in port 26 to the third tray 71 are shifted (offset) in the direction perpendicular to the conveying direction so that the sheets are stored on the third tray 71 in a sorted manner for each bundle. Since a variety of mechanisms are known as such a jog sorting mechanism, description thereof will be skipped.

[Configuration of First Processing Part]

The following describes the respective configurations of the sheet carry-in mechanism, sheet positioning mechanism, binding processing mechanism, and sheet bundle discharge mechanism of the first processing part B1.

[Sheet Carry-In Mechanism]

Figure 3:
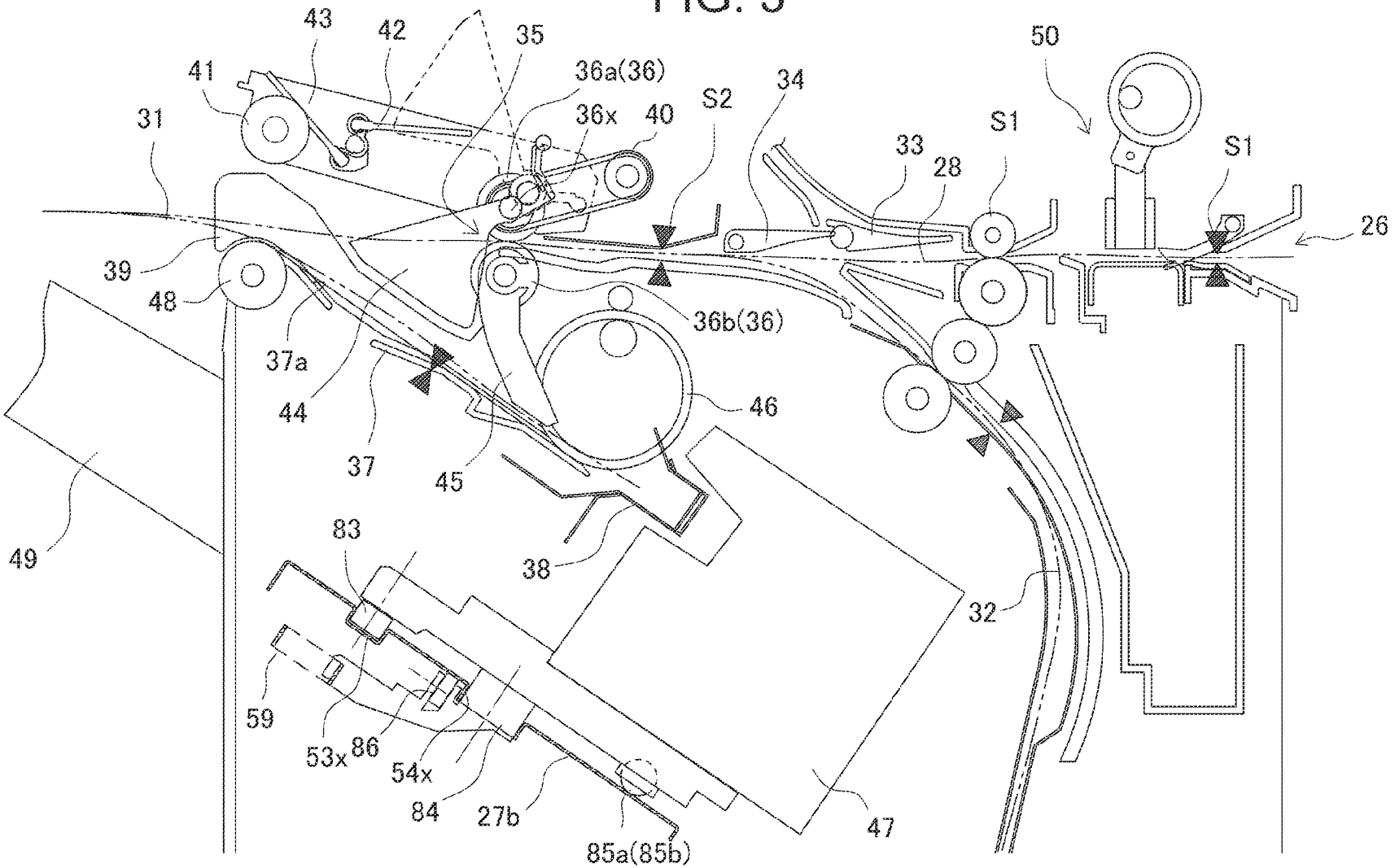
FIG. 3 is an enlarged view of the main part of a path in the apparatus of FIG. 2.

As illustrated in FIG. 3, reverse conveying mechanisms 41 and 42 that convey a sheet in a switchback manner in the direction opposite to the sheet discharge direction from the sheet discharge port 35, a guide mechanism (sheet guide member) 44 for guiding a sheet to the tray side, and a raking rotor 46 (hereinafter, referred to as "raking unit 46") for guiding a sheet to a front end regulating unit are arranged between the sheet discharge port 35 and the processing tray 37.

The reverse conveying mechanism includes an elevating roller 41 configured to be movable upward and downward between an operating position to be engaged with a sheet to be carried in onto the processing tray 37 and a waiting position to be separated therefrom and a paddle rotor 42 for conveying a sheet in the direction opposite to the sheet discharge direction. The elevating roller 41 and paddle rotor 42 are attached to a swing bracket 43.

The swing bracket 43 is disposed at an apparatus frame 27*a* so as to be swingable about a rotary shaft 36*x* (in the drawing, a sheet discharge roller shaft). Rotary shafts of the elevating roller 41 and paddle rotor 42 are bearing-supported by the swing bracket 43. The swing bracket 43 is connected with a not-shown elevating motor, and thus the elevating roller 41 and paddle rotor 42 which are mounted thereon are moved upward and downward between the operating position to be engaged with a sheet and the waiting position to be separated therefrom.

Further, a not-shown drive motor is connected to each of the elevating roller 41 and paddle rotor 42 to transmit a drive force so that the elevating roller 41 is rotated in forward and reverse directions and the paddle rotor 42 is rotated in a reverse direction (a direction opposite to the sheet discharge direction). Further, a driven roller 48 which is brought into pressure contact with the elevating roller 41 is disposed at the processing tray 37, and thus a sheet or a sheet bundle is nipped and conveyed downstream.

The guiding mechanism for guiding the rear end of a sheet carried in onto the processing tray 37 toward a regulating unit 38 is disposed between the elevating roller 41 and the later-described raking rotor 46. As illustrated in FIG. 3, the guide mechanism is constituted by the sheet guide member 44 configured to move upward and downward between a state denoted by a dashed line and a state denoted by a solid line. The sheet guide member 44 retracts to the dashed-line position when a sheet is carried out from the sheet discharge port 35. After the rear end of the sheet passes the sheet discharge port 35, the sheet guide member 44 guides the sheet rear end onto the processing tray 37. To this end, the sheet guide member 44 is connected with a not-shown drive mechanism and is thereby moved upward and downward in accordance with the timing at which the sheet rear end is guided from the sheet discharge port 35 onto the processing tray 37. These raking members are controlled by a not-shown raking controller.

[Sheet Positioning Mechanism]

The positioning mechanisms 38 and 39 for positioning sheets at a predetermined binding position are disposed at the processing tray 37. As illustrated in FIG. 3, the positioning mechanisms are constituted by a sheet end regulating unit 38 against which the sheet rear end abuts for regulation and a side edge aligning unit 39 for positioning the side edge of a sheet at a reference position (center reference, side reference).

As illustrated in FIG. 3, the sheet end regulating unit 38 is constituted by a stopper member against which the sheet rear end abuts for regulation. Although the side edge aligning member 39 will be described later with reference to FIG. 5, in the illustrated apparatus, a sheet is discharged from the sheet carry-in path 28 in center reference. Then, depending on a binding mode, the sheet is positioned in center reference as well or side reference.

[Side Edge Aligning Unit (Aligning Unit)]

Figure 5:
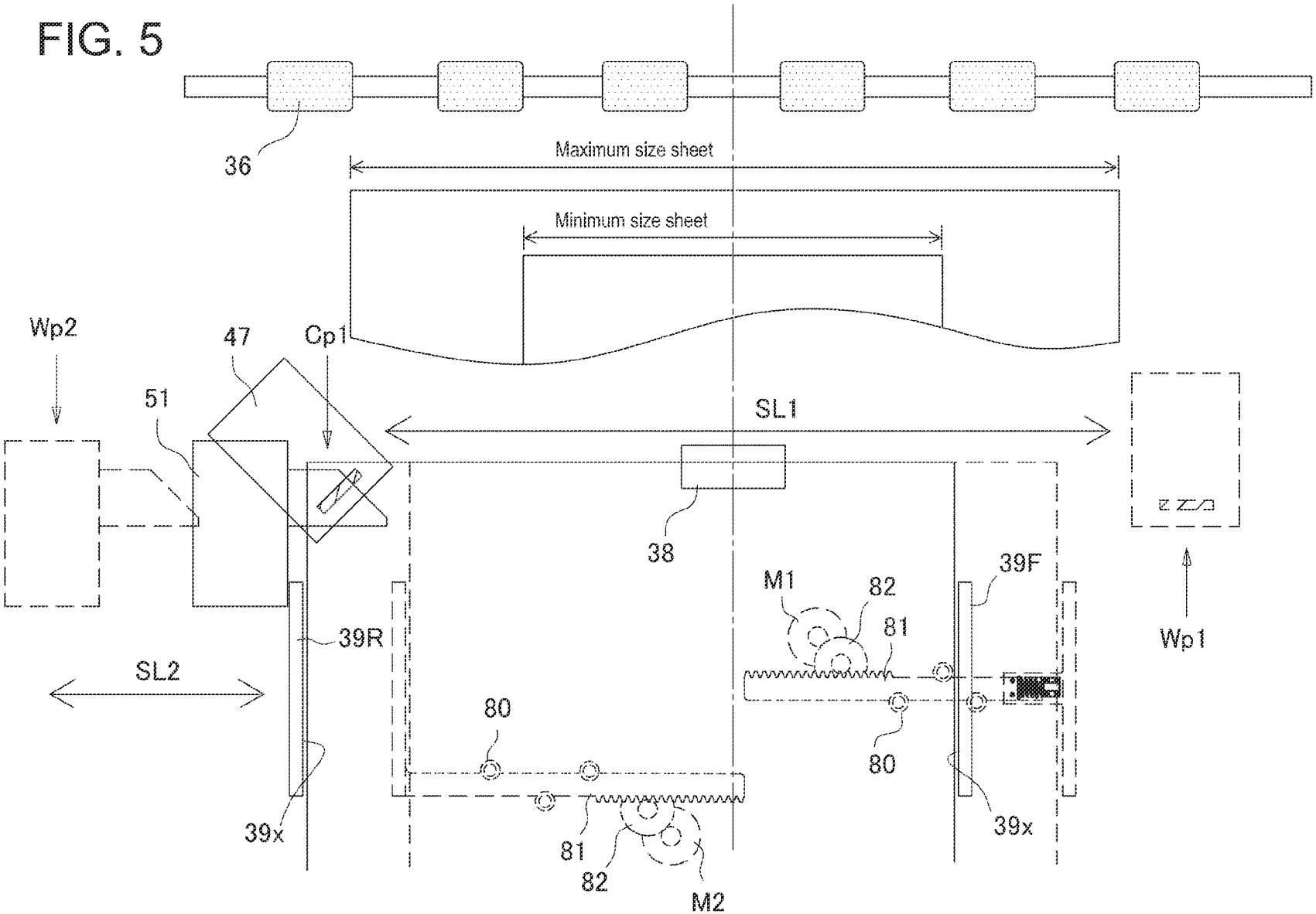
FIG. 5 is an explanatory view illustrating the arrangement relation between an aligning position and the stapling unit in the apparatus of FIG. 2.

As illustrated in FIG. 5, a side (right side) edge aligning plate 39F and a side (left side) edge aligning plate 39R protrude upward from a sheet placing surface 37*a* of the processing tray 37 so as to face each other in the left-right direction, each of the plates 39F and 39R having a regulating surface 39*x* to be engaged with the corresponding side edge of the sheet. The pair of side edge aligning units 39 are disposed at the processing tray 37 so as to be capable of reciprocating by a predetermined stroke. The stroke is set in accordance with a size difference between a maximum size sheet and a minimum size sheet and an offset amount of rightward or leftward moving (offset conveying) of an aligned sheet bundle.

That is, the movement stroke of the right and left side edge aligning units 39F and 39R is set in accordance with a movement amount for aligning different size sheets and an offset amount of the aligned sheet bundle. As offset movement of the side edge aligning plates 39F and 39R, in the corner binding operation, a sheet discharged in center reference is moved by a predetermined amount rightward for right corner binding and leftward for left corner binding. The offset movement is performed one by one (for each carried-in sheet) each time when a sheet is carried in to the processing tray 37 or performed for each bundle to be bound after sheets are aligned in a bundle shape.

Thus, as illustrated in FIG. 5, the side edge aligning unit 39 is constituted by the right side edge aligning member 39F (apparatus front side) and the left side edge aligning member 39R (apparatus rear side). Both the side edge aligning members are supported by the processing tray 37 such that the regulating surfaces 39*x* engaged with side edges of a sheet are mutually moved in an approaching direction or a separating direction. Slit grooves (not illustrated) are formed to penetrate the processing tray 37. The side edge aligning members 39F and 39R each having the regulating surface 39*x* engaged with the side edge of a sheet are slidably fitted to the slits so as to protrude from the upper surface of the processing tray 37.

The respective side edge aligning members 39F and 39R are slidably supported at the back face of the processing tray 37 with a plurality of guide rollers 80 (or may be a rail member) and each integrally have a rack 81. Aligning motors M1 and M2 are connected to the right and left racks 81, respectively, through a pinion 82. The right and left aligning motors M1 and M2 are stepping motors. The positions of the right and left side edge aligning members 39F and 39R are detected by a not-shown position sensor. The respective side edge aligning members 39F and 39R are configured to be movable by a specified movement amount in both right and left directions with reference to the detection values from the position sensor.

It can be configured such that, without the illustrated rack-and-pinion mechanism, the side edge aligning members 39F and 39R are fixed to a timing belt which is connected to a motor through a pulley for causing the timing belt to reciprocate to the right and left.

With the abovementioned configuration, the later-described controller 95 causes the right and left side edge aligning members 39F and 39R to wait at predetermined waiting positions (positions to be mutually apart by a sheet width+$\alpha$) based on sheet size information provided from the image forming apparatus A and the like. In the multi-binding operation, the aligning operation is started at the timing when the rear end of a sheet abuts against the rear end regulating unit 38 after the sheet is carried in onto the processing tray 37. In the aligning operation, the right and left aligning motors M1 and M2 are rotated in opposite directions (mutually approaching directions) by the same amount.

Sheets carried in onto the processing tray 37 are positioned with reference to the sheet center and stacked in a bundle. With the repetition of the carry-in operation and aligning operation of sheets, the sheets are collated and stacked in a bundle on the processing tray 37. At this time, sheets having different sizes are positioned in center reference. In the corner binding operation, the aligning operation is started at the timing when the rear end of a sheet abuts against the rear end regulating unit 38 after the sheet is carried in onto the processing tray 37. In the aligning operation, the movement amount of the aligning plate at the binding position side is made different from the movement amount of the aligning plate at the side opposite to the binding position. The respective movement amounts are set so that the sheet corner is located at a previously-set binding position.

When "non-staple binding" to be described later is performed at the sheet corner, a sheet discharged onto the processing tray 37 in center reference is aligned and positioned with respect to the center by the side aligning members 39F and 39R, so as to be stacked in a bundle. After a predetermined number of sheets to be bound are stacked, the sheet bundle is moved leftward (the side of the side aligning member 39R) to a non-staple binding position while being sandwiched by the side aligning members 39F and 39R.

When the "non-staple binding processing" is performed for sheets each having a size exceeding a predetermined size and the number of which exceeds a predetermined number, a sheet discharged onto the processing tray 37 in center reference is aligned and positioned with reference to the center by the side aligning members 39F and 39R. Then, when the thus aligned and positioned sheets are stacked in a predetermined number, they are moved in a bundle to the non-staple binding position while being sandwiched by the side aligning members 39F and 39R. Thereafter, the side aligning member 39R is left at the non-staple binding position, while the side aligning member 39F is returned to a sheet receiving position so as to receive the next sheet. Then, at the timing when the next sheet is discharged onto the processing tray 37, the side aligning member 39F is moved in a direction approaching the side aligning member 39R. Thus, the sheets equal to or exceeding the predetermined number (sheets discharged after the bundle shifting operation) are moved to the non-staple binding position one by one.

[Binding Processing Mechanism]

Binding processing mechanisms 47 and 51 for performing binding processing for a sheet bundle stacked on the sheet placing surface 37*a* are disposed at the processing tray 37. Sheets are positioned at a predetermined binding position on the sheet placing surface 37*a* of the processing tray 37 by the positioning mechanisms (sheet end regulating unit 38 and side edge aligning unit 39). As the binding processing mechanisms 47 and 51, a first binding unit 47 (stapling unit) for performing staple binding for a sheet bundle using a staple and a second binding unit 51 (eco-binding unit) for performing non-staple binding are selectively disposed at the binding position.

As illustrated in FIG. 2, the binding processing mechanisms 47 and 51 for performing binding processing at the rear end of the sheets carried in from the sheet discharge port 35 are disposed at the processing tray 37. The binding processing mechanisms include the stapling unit (first binding unit) 47 configured to be movable along the rear end of the sheet placing surface 37*a* of the processing tray 37 and the eco-binding unit (second binding unit) 51, as illustrated in FIG. 4.

Figure 4:
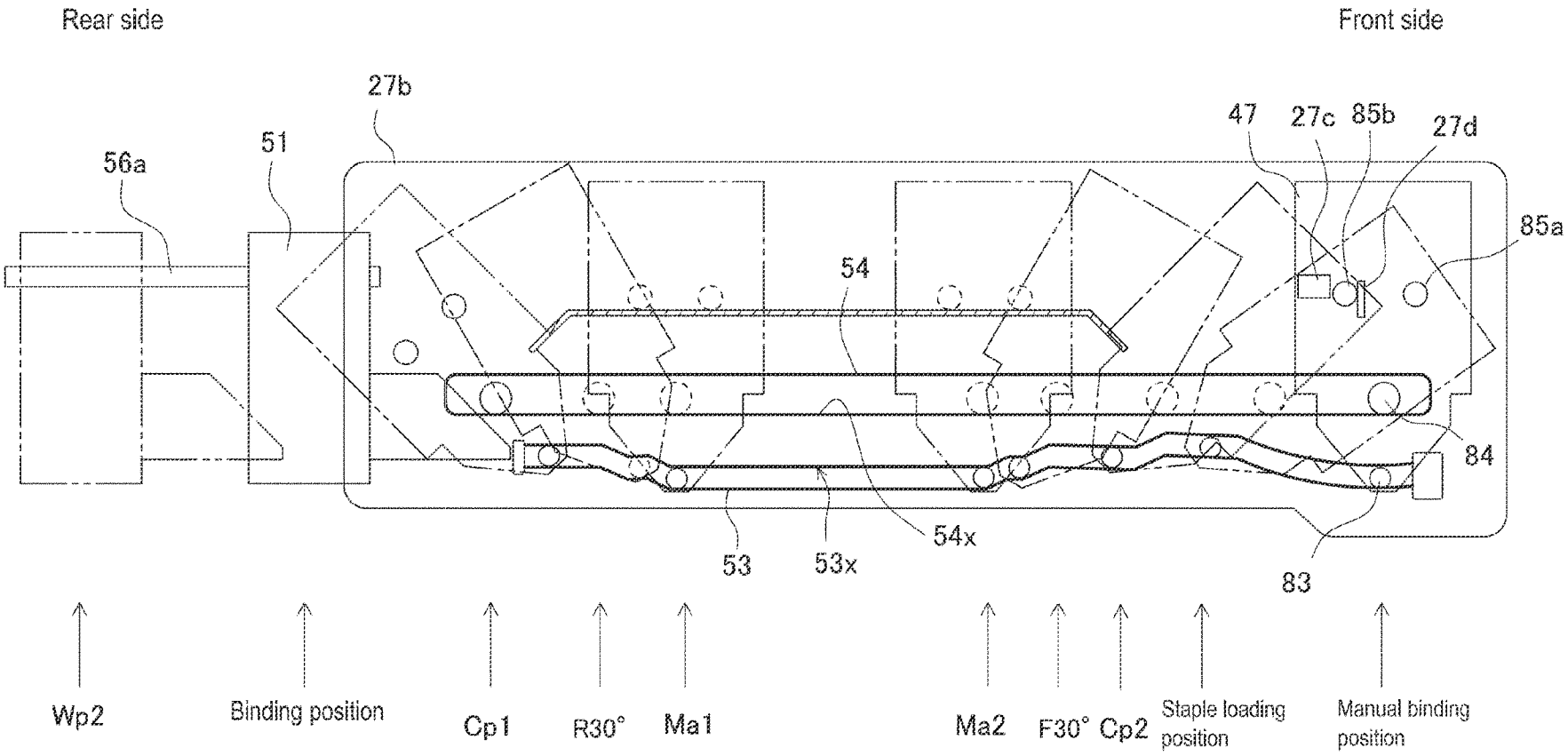
FIG. 4 is movement trajectories of a stapling unit and an eco-binding unit.

FIG. 4 illustrates the stapling unit (first binding unit) 47 and the eco-binding unit (second binding unit) 51 which are disposed at the processing tray 37. In the illustrated apparatus, a binding position Cp1 is set at a sheet corner located at the upper-left side in the drawing. The first binding unit 47 and second binding unit 51 are moved contrary to the binding position Cp1.

The first binding unit 47 is configured to move by a predetermined stroke SL1 along a first travel rail 53 and a second travel rail 54 which are formed at an apparatus frame 27*b*. Similarly, the second binding unit 51 is configured to move by a predetermined stroke SL2 along a first guide rod 56*a* and a second guide rod 56*b* (see FIG. 9B) which are arranged at an apparatus frame 57.

FIG. 5 illustrates a sheet carried in onto the processing tray 37 and the movement strokes of the first and second binding units 47 and 51. Sheets having different sizes (between the maximum size sheet and the minimum size sheet) are carried in onto the processing tray 37 in center reference. The sheets are aligned by the right-left pair of side edge aligning members 39F and 39R with reference to a sheet side edge at the binding side (left side edge in the drawing) (that is, such that the left side edges of the sheets having different sizes are matched). The right and left aligning members 39F and 39R are connected respectively to the separate drive motors M1 and M2. The later-described controller 95 sets movement amounts of the right and left aligning members 39F and 39R in accordance with sheet sizes.

In binding processing other than the sheet corner binding processing, for example, in the multi-binding processing to be described later, the controller 95 to be described later causes sheets to be aligned in center reference. In this case, the sheets are positioned at the binding position owing to that the right and left aligning members 39F and 39R are moved toward the sheet center from their waiting positions by the same amount.

Referring to FIG. 5, the first binding unit 47 is moved by the first stroke SL1 between a waiting position Wp1 (first waiting position) and the binding position Cp1. The second binding unit 51 is moved by the second stroke SL2 between a waiting position Wp2 (second waiting position) and the binding position Cp1. That is, the first binding unit 47 is caused to reciprocate between the first waiting position Wp1 and the binding position Cp1 along the travel rails 53 and 54 (guide grooves, guide rods, or the like) and the second binding unit 51 is caused to reciprocate between the second waiting position Wp2 and the binding position Cp1 along the guide rods 56*a* and 56*b* (or may be guide grooves).

The binding position Cp1 is set at a sheet corner (hereinafter, called a set binding position), and the first waiting position Wp1 and the second waiting position Wp2 satisfy the following relations with the set binding position Cp1:

(1) The first waiting position Wp1 and the second waiting position Wp2 are located at opposite sides sandwiching the set binding position Cp1;

(2) The first waiting position Wp1 is set at the outer side of the maximum size sheet for which binding processing is to be performed on the processing tray 37 or a binding processing position being farthest from the set binding position Cp1 on the processing tray 37 (a later-described multi-binding position Ma or manual binding position Mp; the farthest binding position);

(3) The second waiting position Wp2 is set at the outer side of the sheet side edge aligned at the set binding position (outside a sheet placing area of the sheet placing surface);

(4) The first stroke SL1 between the first waiting position Wp1 and the set binding position Cp1 is set larger (longer) than the second stroke SL2 between the second waiting position Wp2 and the set binding position Cp1.

Owing to that the first waiting position Wp1 and second waiting position Wp2 are set at opposite sides with respect to the set binding position Cp1 as described above, it is possible that one unit is moved in a separating direction while the other unit is moved in an approaching direction (contrary retracting-approaching operation). Further, owing to that the first stroke SL1 is set larger than the second stroke SL2, the binding processing position (multi-binding position Ma to be described later) of the first binding unit 47 can be set relatively freely. In contrast, the second binding unit 51 performs binding processing only at a preset binding position. Accordingly, the length of the total movement stroke of the first and second binding units 47 and 51 can be set small, and thus the apparatus can be made compact.

Further, the controller 95 to be described later may move the first and second binding units 47 and 51 in a contrary manner such that the second binding unit 51 is located at the waiting position Wp2 when the first binding unit 47 is at the set binding position Cp1 and the first binding unit 47 is located at the waiting position Wp1 when the second binding unit 51 is at the set binding position Cp1. That is, when sheets are to be bound by one binding unit, the other binding unit may be located at the outside (outer side) of a sheet carry-in area of the sheets carried in onto the processing tray 37 (the sheets to be bound by the one binding unit), that is, at the outside of the sheets on the processing tray 37 (in a state that the sheets to be bound by the one binding unit does not enter the opening portion of the other binding unit). With this configuration, a sheet bundle is prevented from being disarranged in posture due to interference with the opening portion of the second binding unit 51 when the first binding unit 47 performs binding processing therefor. Further, the number of sheets for which binding process is to be performed by the first binding unit 47 is not limited by the binding processing performance of the second binding unit 51 having the low binding processing performance.

The contrary movement of the first and second binding units 47 and 51 is performed by one of the following methods:

(1) Differentiating rotational amounts in accordance with movement strokes with separate drive motors; and (2) Differentiating movement amounts between the first binding unit 47 and the second binding unit 51 with the same drive source.

Figure 6:
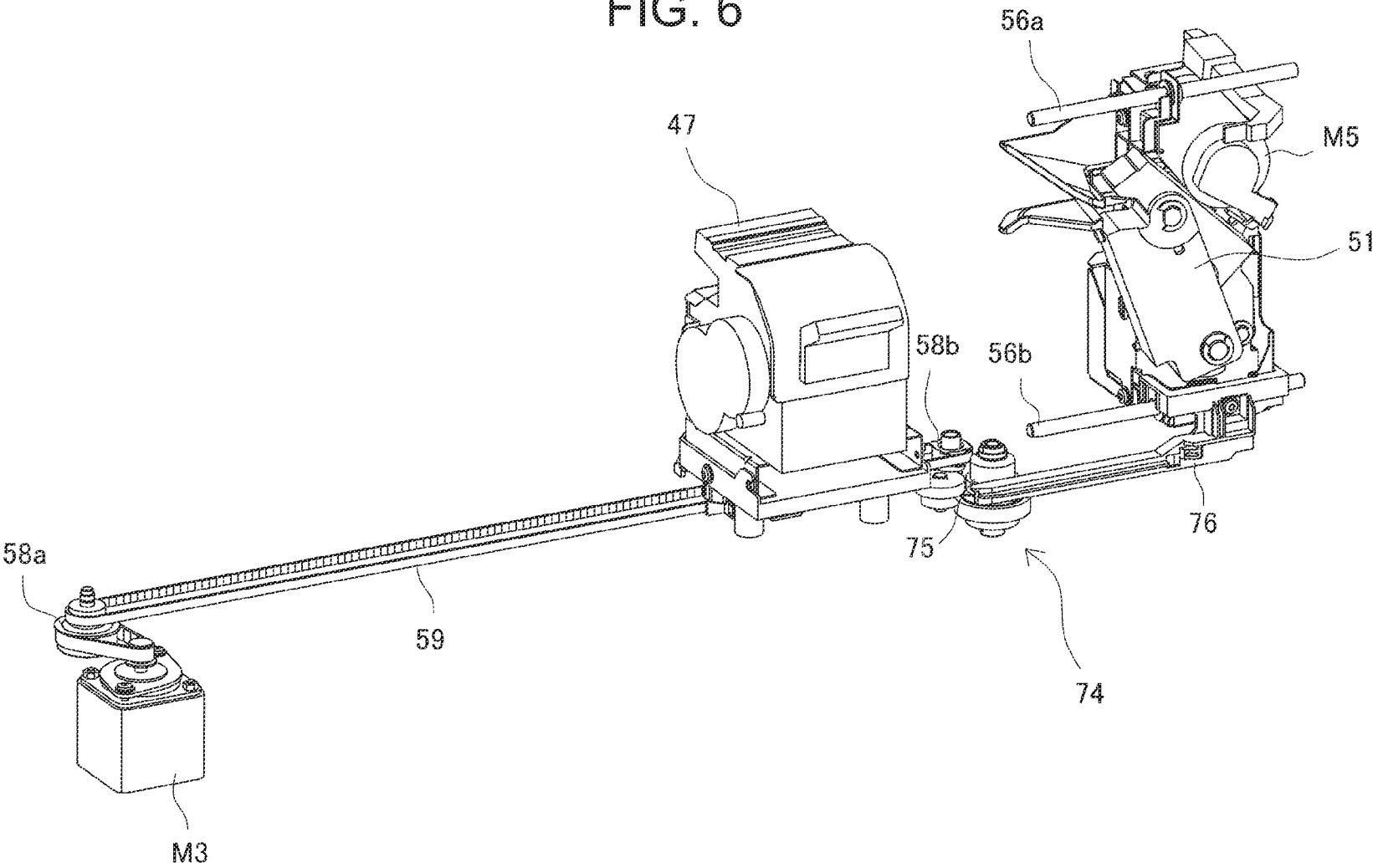
FIG. 6 is a view illustrating a slide mechanism of a binding unit.

FIG. 6 illustrates an embodiment to differentiate movement amounts of the first binding unit 47 and second binding unit 51 with the same drive source. A right-left pair of pulleys 58*a* and 58*b* are disposed at the apparatus frame 27*b* along the movement area of the first binding unit 47 (in the left-right direction in FIG. 6). A timing belt (toothed belt) 59 is routed between the pulleys 58*a* and 58*b*, and a drive motor M3 (stepping motor) is connected to one of the pulleys, 58*a*.

A transmitting pinion 75 is connected to the other pulley, 58*b*, through a differential unit (transmitting unit) 74. A rack 76, which is fixed to the frame of the second binding unit 51, is engaged with the transmitting pinion 75. The differential unit 74 is constituted by a gear mechanism (a first embodiment described below) having a transfer ratio matched to the difference between the first and second strokes SL1, SL2, a slide clutch mechanism (a second embodiment described below), or a combination of both the above mechanisms.

[First Embodiment of Differential Unit]

Figure 7A:
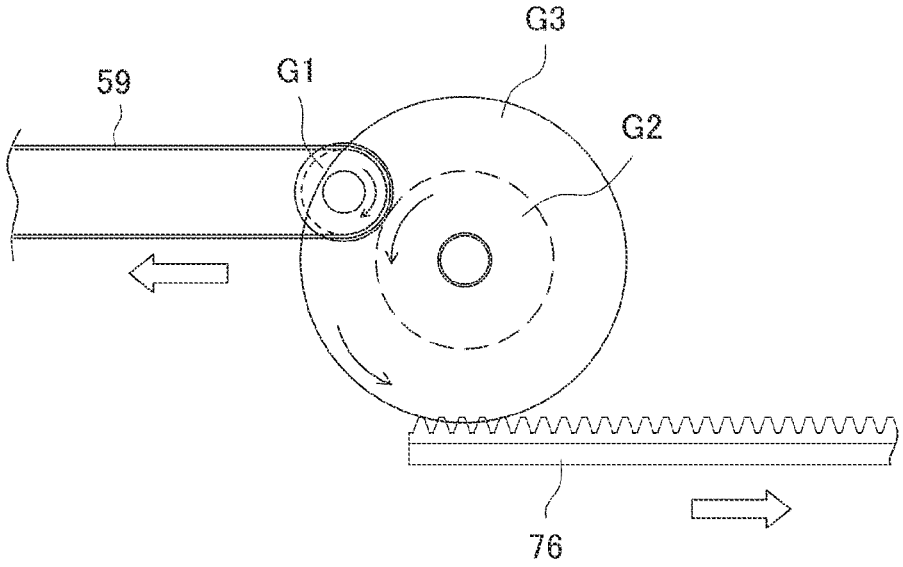
FIGS. 7A and 7B are explanatory views illustrating a first embodiment of a differential unit in the apparatus of FIG. 2.
Figure 7B:
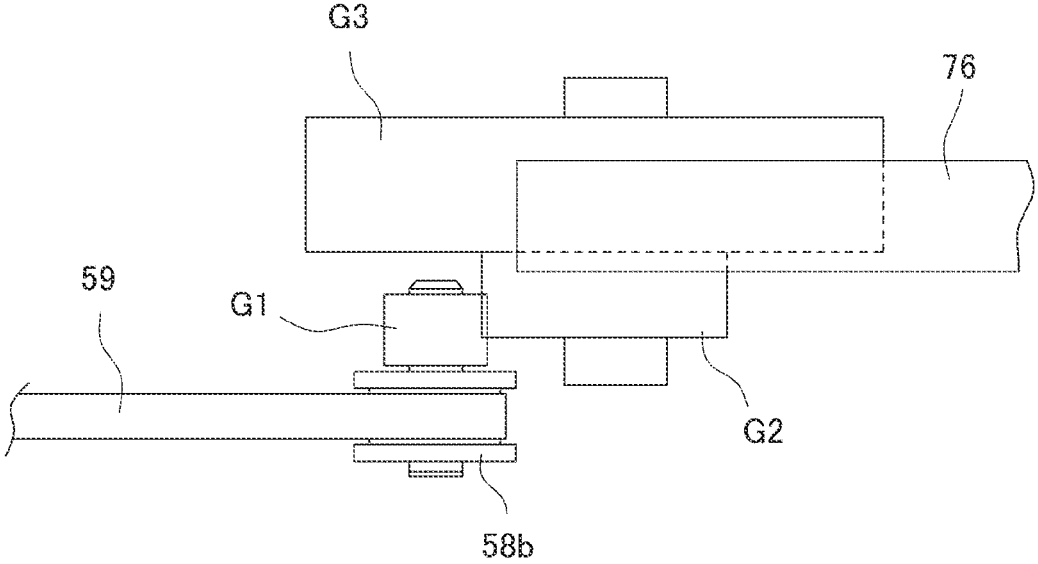

FIGS. 7A and 7B illustrate the first embodiment of the differential unit 74. When the drive motor M3 is rotated by a predetermined rotational amount in the transmitting mechanism, the perspective view of which is illustrated in FIG. 6, the first binding unit 47 is linearly moved in a reciprocating manner by the first stroke SL1, and the second binding unit 51 is linearly moved in a reciprocating manner by the second stroke SL2 according to the rotational amount. The transfer rate is thus differentiated.

For example, in the illustrated apparatus, since the second stroke SL2 is set to one-fifth of the first stroke SL1, the gear ratio of a gear G1 connected to the drive motor M3 is set to five times larger than the gear ratio of a gear G3 connected to the gear G1 through a gear G2 and engaged with the rack 76. In FIG. 7B, the transmitting gear G1 is provided on the pulley (driven pulley) 58*b* connected to the drive motor M3. The gear G2 driven by the transmitting gear G1 is connected to the gear G3 engaged with the rack 76 so as to be rotated coaxially and integrally therewith. The gear ratio of the gear G1 and the gears G2, G3 is set to match the stroke ratio of the first and second strokes SL1 and SL2.

Thus, when the drive motor M3 is rotated by a predetermined amount, the first binding unit 47 is moved by the first stroke SL1, and at the same time, the second binding unit 51 is moved by the second stroke SL2. The respective movements are set in the same direction.

[Second Embodiment of Differential Unit]

As illustrated in the perspective view of FIG. 6, the timing belt 59 for the first binding unit 47 is connected to the drive motor M3. As described above, the movement stroke SL1 of the first binding unit 47 is set longer than the movement stroke SL2 of the second binding unit 51. Thus, in a differential unit 77 illustrated in FIGS. 8A to 8D, a slide clutch unit 78 is disposed at a transmitting unit for the second binding unit 51 having a short movement distance.

Figure 8A:
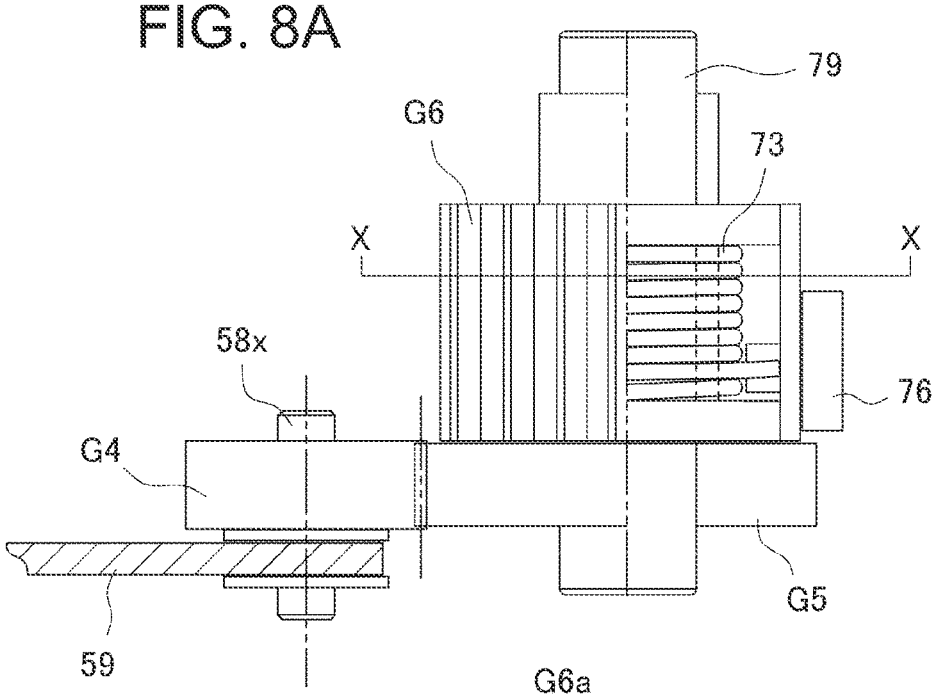
FIGS. 8A to 8D are explanatory views illustrating a second embodiment of the differential unit in the apparatus of FIG. 2.

FIG. 8A illustrates an example of the slide clutch mechanism. A transmitting gear G4 is provided integrally with a pulley shaft 58*x* for the timing belt 59 which is connected to the drive motor M3 so as to move the first binding unit 47 in a reciprocating manner, and a gear G5 engaged with the gear G4 is mounted integrally with a transmitting rotary shaft 79. Further, a transmitting pinion G6 is loosely fitted to an outer circumference of the transmitting rotary shaft 79 in a rotatable manner. The rack 76 fixed to the second binding unit 51 is connected to the transmitting pinion G6 so as to be engaged therewith.

A clutch spring 73 is provided between the transmitting rotary shaft 79 connected to the drive motor M3 and the transmitting pinion G6 which is loosely mounted to the transmitting rotary shaft 79 so as to generate a sliding motion between the transmitting rotary shaft 79 and the transmitting pinion G6 when a load torque transmitted to the transmitting pinion G6 exceeds a predetermined value.

Figure 8B:
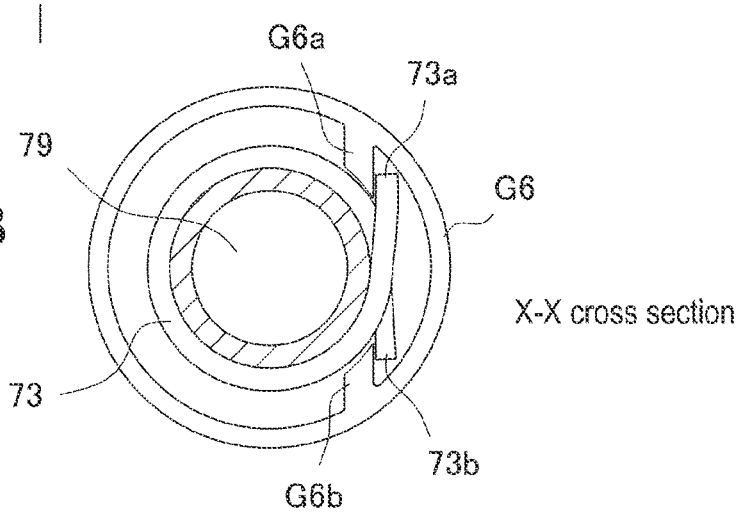
Figure 8C:
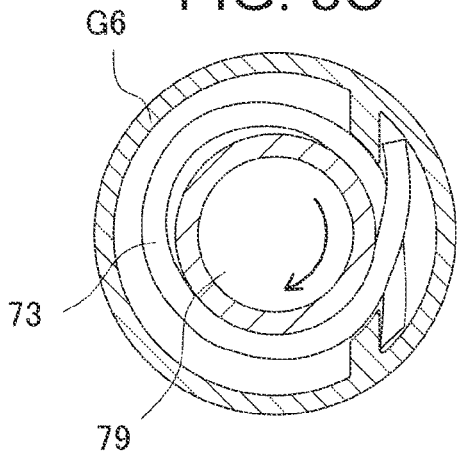
Figure 8D:
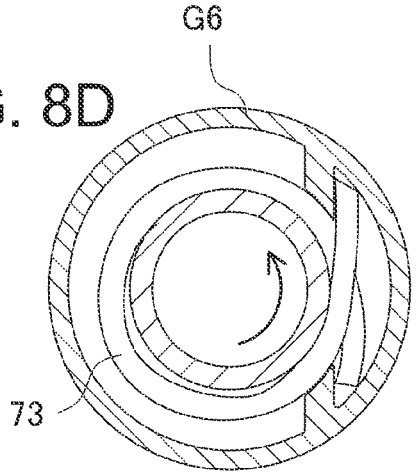

As illustrated in FIGS. 8B, 8C, and 8D, free ends 73*a* and 73*b* of the clutch spring 73 are engaged with protrusions G6*a* and G6*b* protruding from the transmitting pinion G6. The clutch spring 73 and the transmitting rotary shaft 79 are frictionally engaged with each other. Owing to the frictional relation, when the load torque of the transmitting pinion G6 exceeds a predetermined value, the clutch spring 73 is relaxed to generate a slip between the transmitting rotary shaft 79 and transmitting pinion G6, while when the load torque is equal to or smaller than the predetermined value, rotational energy is transmitted in a state of FIG. 8B. Further, when the load torque exerted on the second binding unit 51 exceeds a predetermined value, a slip occurs between the transmitting rotary shaft 79 and the transmitting pinion G6 by rotation in directions indicated by arrows in FIGS. 8C and 8D.

With the configuration described above, when the first binding unit 47 is moved by rotation of the drive motor M3 from the set binding position Cp1 to the waiting position Wp1, the clutch spring 73 in the state of FIG. 8B is interlocked with the second binding unit 51 to move the second binding unit 51 from the waiting position Wp2 toward the set binding position Cp1. When the second binding unit 51 arrives at the set binding position Cp1 and abuts against an engaging stopper (not illustrated), a load torque having an almost-infinite value is exerted to the transmitting pinion G6. Owing to excess of the load torque, a gap is formed between the clutch spring 73 and the transmitting rotary shaft 79 to generate the sliding motion. Then, subsequent rotation of the drive motor M3 moves the first binding unit 47 toward the waiting position Wp1.

Similarly, the transmitting rotation and sliding rotation by the clutch spring 73 occur in series also when the first binding unit 47 is moved from the waiting position Wp1 to the set binding position Cp1 (rotation reverse to motor rotation). Thus, the first binding unit 47 reciprocates in the first stroke SL1 by forward-reverse rotation of the drive motor M3. During the initial stage of the movement, the second binding unit 51 reciprocates along therewith in the second stroke SL2. Thereafter, the rotation of the drive motor M3 is transmitted only to the first binding unit 47.

[Moving Mechanism of Stapling Unit]

As illustrated in FIG. 3, the stapling unit 47 is mounted on the apparatus frame (chassis frame) 27*b* movably by a predetermined stroke. The first travel rail 53 and second travel rail 54 are disposed at the apparatus frame 27*b*. The first travel rail 53 has a travel rail surface 53*x*, and the second travel rail 54 has a travel cam surface 54*x*. The travel rail surface 53*x* and travel cam surface 54*x* support the stapling unit 47 (hereinafter in this section, referred to as "moving unit") in mutual cooperation so as to allow the stapling unit 47 to reciprocate by a predetermined stroke and control an angular posture thereof.

The first travel rail 53 and second travel rail 54 are formed so that the travel rail surface 53*x* and travel cam surface 54*x* allow the moving unit to reciprocate within a movement range thereof (see FIG. 5). The timing belt 59, which is connected to the drive motor (travel motor) M3, is fixed to the moving unit (stapling unit) 47. The timing belt 59 is wound around the pair of pulleys 58*a* and 58*b* which are axially supported by the apparatus frame 27*b*, and the drive motor M3 is connected to one of the pulleys. Accordingly, the stapling unit 47 reciprocates by the stroke SL1 by forward and reverse rotation of the drive motor M3.

The travel rail surface 53*x* and travel cam surface 54*x* are arranged to include a parallel interval section (having a span I1) where the surfaces are in parallel, a narrow swing interval section (having a span I2), and a narrower swing interval section (having a span I3) (span I1>span I2>span I3). The span I1 causes the stapling unit to be in a posture parallel to the sheet rear end edge. The span I2 causes the stapling unit to be in a slant posture rightward or leftward. The span I3 causes the stapling unit to be in a posture slant at a larger angle. Thus, the slant angle of the stapling unit is varied.

The moving unit 47 is engaged with the first and second travel rails 53 and 54 as described below. As illustrated in FIG. 3, the moving unit 47 is provided with a first rolling roller (rail fitting member) 83 engaged with the travel rail surface 53*x* and a second rolling roller (cam follower member) 84 engaged with the travel cam surface 54*x*. Further, the moving unit 47 is provided with a sliding roller 85 (in the drawing, ball-shaped sliding rollers 85*a* and 85*b* at two positions) engaged with the support surface of the frame 27*b*. Further, a guide roller 86 engaged with the bottom surface of a bottom frame part is formed at the moving unit 47 to prevent the moving unit 47 from floating from the bottom frame 27*b*.

With the above configuration, the moving unit 47 is movably supported by the bottom frame 27*b* through the sliding roller 85 and guide roller 86. Further, the first rolling roller 83 and the second rolling roller 84 are rotated and moved along the travel rail surface 53*x* and the travel cam surface 54*x* following the travel rail surface 53*x* and the travel cam surface 54*x*, respectively.

The travel rail surface 53*x* and travel cam surface 54*x* are arranged so that the parallel distance sections (having the span I1) are formed at the multi-binding positions Ma1, Ma2 and manual binding position Mp. With the span I1, the moving unit 47 is maintained in a posture perpendicular to the sheet end edge without being swung, as illustrated in FIG. 4. Accordingly, at the multi-binding positions Ma1 and Ma2 and manual binding position Mp, a sheet bundle is bound with a staple being parallel to a sheet end edge.

Further, the travel rail surface 53*x* and travel cam surface 54*x* are arranged so that the swing interval sections (having the span I2) are formed at the right corner binding position Cp2 and left corner binding position Cp1. The moving unit 47 is maintained in a rightward-angled posture (e.g., rightward-angled by 45 degrees) or in a leftward-angled posture (e.g., leftward-angled by 45 degrees), as illustrated in FIG. 4.

Further, the travel rail surface 53*x* and travel cam surface 54*x* are arranged so that the swing interval section (having the span I3) is formed at a position for staple loading. The span I3 is formed to be shorter than the span I2. In this state, the moving unit 47 is maintained in a rightward-angled posture (e.g., rightward-angled by 60 degrees) as illustrated in FIG. 4. The reason why the angular posture of the moving unit 47 is changed at the staple loading position is that the posture is matched with an angular direction in which a staple cartridge 52 is mounted thereon, and the angle is set in relation with an open-close cover arranged at an external casing.

For shortening the movement length in changing the angular posture of the moving unit 47 using the travel rail surface 53*x* and travel cam surface 54*x*, it is preferable from a viewpoint of layout compactification to arrange a second travel cam surface or a stopper cam surface for angle changing in cooperation with the travel cam surface.

The following describes the stopper cam surface with reference to FIG. 4. As illustrated in FIG. 4, stopper surfaces 27*c* and 27*d* engaged with a part of the moving unit 47 (in the drawing, the sliding roller 85) are disposed at the bottom frame 27*b* to change the posture of the moving unit 47 between the right corner binding position Cp2 and the manual binding position Mp at the apparatus front side. The moving unit 47 inclined at the staple loading position is required to be corrected in inclination at the manual binding position Mp. In this case, when the angle is changed only by the travel rail surface 53*x* and travel cam surface 54*x*, the movement stroke becomes long.

Thus, when the moving unit 47 is moved toward the manual binding position Mp in a state of being locked by the stopper surface 27*c*, the moving unit 47 is returned to the original state from the inclined state. Further, when the moving unit 47 is returned to the opposite direction from the manual binding position Mp, the moving unit 47 is (forcedly) inclined to face toward the corner binding position by the stopper surface 27*d*.

[Configuration of Stapling Unit]

Figure 9A:
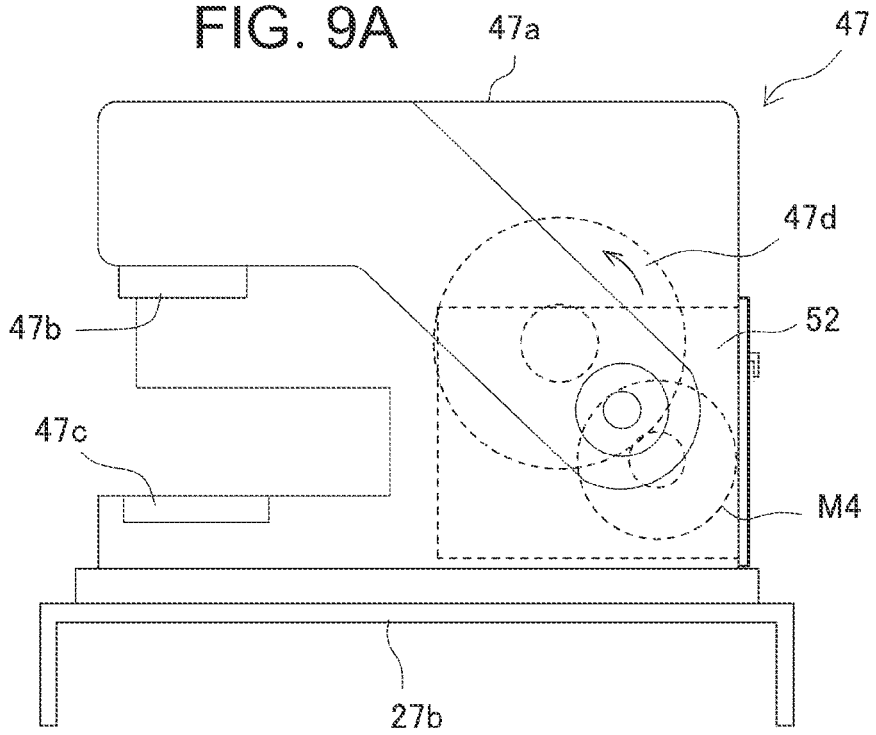

The configuration of the stapling unit (first binding unit) 47 will be described with reference to FIG. 9A. The stapling unit 47 is configured as a unit separated from the sheet post-processing apparatus B. The stapling unit 47 includes a box-shaped unit frame 47*a*, a drive cam 47*d* swingably axially supported by the unit frame 47*a*, and a drive motor M4 mounted on the unit frame 47*a* so as to rotate the drive cam 47*d*.

The stapling unit 47 has a stapling head 47*b* and an anvil member 47*c* which are disposed opposite to each other at the binding position. The stapling head 47*b* is vertically moved between a waiting position at the upper side and a stapling position at the lower side (anvil member) by the drive cam 47*d* and a biasing spring (not illustrated). Further, the staple cartridge 52 is detachably mounted on the unit frame 47*a*.

Linear blank staples are stored in the staple cartridge 52 and fed to the stapling head 47*b* by a staple feeding mechanism. A former member to fold a linear staple into a U-shape and a driver to cause the folded staple to bite into a sheet bundle are built in the stapling head 47*b*. With such a configuration, the drive cam 47*d* is rotated by the drive motor M4 and energy is stored in the biasing spring. Then, when the rotational angle reaches a predetermined angle, the stapling head 47*b* is vigorously lowered toward the anvil member 47*c*. Owing to this action, a staple is caused to bite into a sheet bundle by the driver after being folded into a U-shape. Then, leading ends of the staple are folded by the anvil member 47*c*, so that the staple binding is completed.

The stapling feed mechanism is incorporated between the staple cartridge 52 and the stapling head 47*b*, and a sensor (empty sensor) to detect the absence of a staple is arranged at the staple feed mechanism. Further, a cartridge sensor (not illustrated) to detect whether or not the staple cartridge 52 is inserted is disposed at the unit frame 47*a*.

The illustrated staple cartridge 52 has a structure in which belt-shaped connected staples are stacked forming a layer and stored or are stored in a roll-shape in a box-shaped cartridge. Further, a circuit to control the abovementioned sensors and a circuit board to control the drive motor M4 are provided at the unit frame 47*a* and issues an alarm signal when the staple cartridge 52 is not mounted or the staple cartridge 52 is empty. Further, the stapling control circuit controls the drive motor M4 to perform the stapling operation using a staple signal and issues an operation completion signal when the stapling head 47*b* is moved to the anvil position from the waiting position and returned again to the waiting position.

[Structure of Non-Staple Binding Unit]

The structure of the second binding unit (non-staple binding unit) 51 will be described with reference to FIG. 9B. As a binding unit to perform binding processing for a sheet bundle without using a metal staple, there have been known a unit to bind sheets by pressure-nipping a sheet bundle from front and back sides with pressurizing members having mutually engaged concave-convex surfaces (press binding device), a unit to bind sheets by folding them after a slit-shaped cutout is formed in the sheet bundle (a cutout fold binding device; see JP 2011-256008A), and a unit to bind sheets with a plant-derived resin string (resin string binding apparatus). Since a sheet bundle is bound without using a metal staple, the above methods are known as eco-binding methods. In the following, a press binding mechanism is described as an example thereof.

The press binding mechanism is such that a sheet bundle is pressure-nipped, from front and back sides, between pressurizing surfaces 51*b* and 51*c* having concave-convex surfaces and configured to be brought into mutual pressure contact and separation, with the result that the sheets constituting the sheet bundle are deformed and bound. FIG. 9B illustrates the press binding unit 51. In the press binding unit 51, a movable frame member 51*d* is swingably axially supported by a base frame member 51*a*, and both the frame members 51*a* and 51*d* are swung about a support shaft 51*x* so as to be brought into mutual pressure contact and separation. A follower roller 60 is disposed at the movable frame member 51*d* and is engaged with a drive cam 68 disposed at the base frame member 51*a*.

A drive motor M5 disposed at the base frame member 51*a* is connected to the drive cam 68 through a deceleration mechanism. Rotation of the drive motor M5 causes the drive cam 68 to rotate, and the movable frame member 51*d* is swung by a cam face (eccentric cam in FIG. 9B) of the drive cam 68.

A lower pressuring surface 51*c* and an upper pressurizing surface 51*b* are disposed, respectively, at the base frame member 51*a* and the movable frame member 51*d* so as to be mutually opposed. A biasing spring (not illustrated) is disposed between the base frame member 51*a* and the movable frame member 51*d* to bias both the pressurizing surfaces 51*c* and 51*b* in mutually separating directions.

Figure 9B:
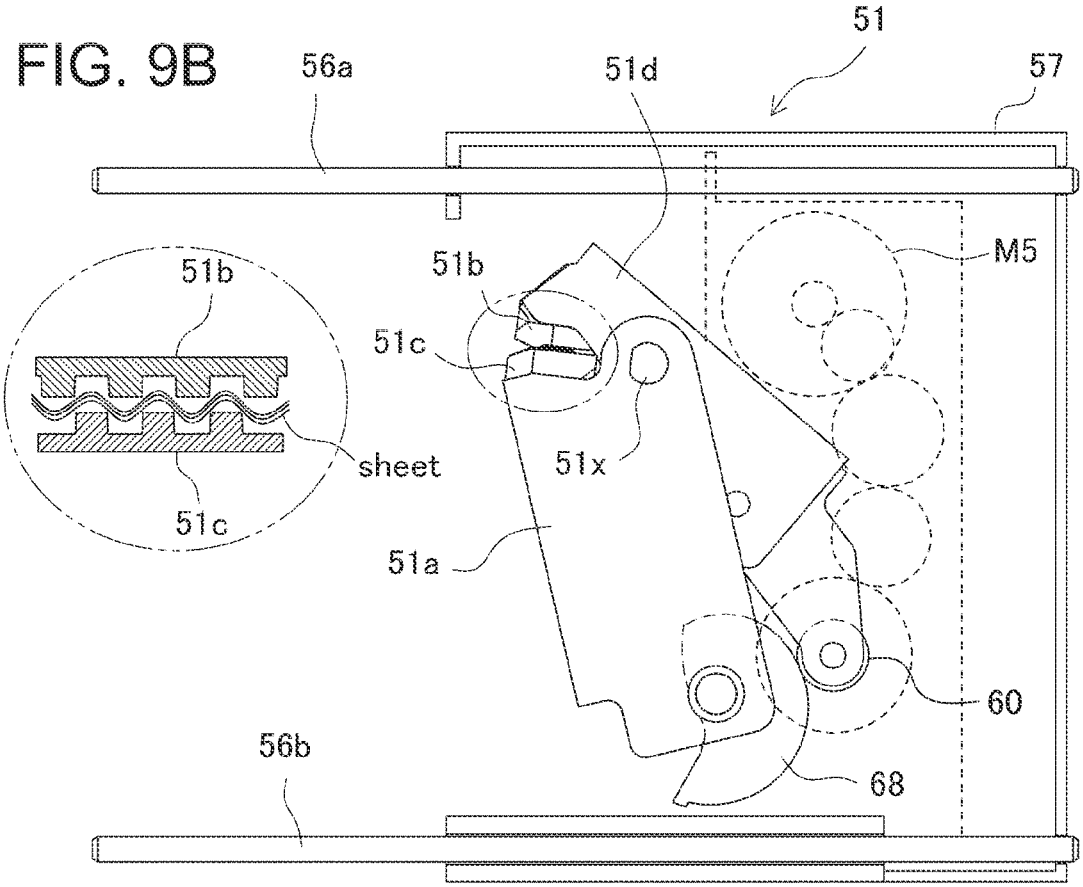

As illustrated in an enlarged view of FIG. 9B, convex stripes are formed on one of the upper and lower pressurizing surfaces 51*b* and 51*c*, and concave grooves to be matched therewith are formed on the other thereof. The convex stripes and the concave grooves are formed respectively into rib shapes each having a predetermined length. A sheet bundle nipped between the upper and lower pressurizing surfaces 51*b* and 51*c* closely contact each other in a state of being deformed into a corrugation shape. A not-shown position sensor is disposed at the base frame member (unit frame) 51*a* and detects whether or not the upper and lower pressurizing surfaces 51*b* and 51*c* are at the pressurization positions or separation positions.

The press binding unit (eco-binding unit, the second binding unit) 51 configured as described above is movably disposed on the first and second guide rods 56*a* and 56*b* (may be grooves as well) which are disposed at the apparatus frame 57 and reciprocates between the second waiting position Wp and the set binding position Cp1 for sheets stacked on the processing tray 37, as described above.

[Sheet Bundle Carry-Out Mechanism]

The sheet bundle carry-out mechanism for carrying out a bound sheet bundle toward the first tray 49 located on the downstream side is disposed at the processing tray 37. For conveying a sheet bundle toward the downstream side, there have been known a method for conveying the sheet bundle using a pair of rollers (discharge unit) which are brought into pressure contact to each other and a conveying unit for pushing out the rear end of a sheet using a push-out member configured to move along a tray surface from the upstream side to the downstream side. The illustrated apparatus employs both the above means.

Figure 10A:
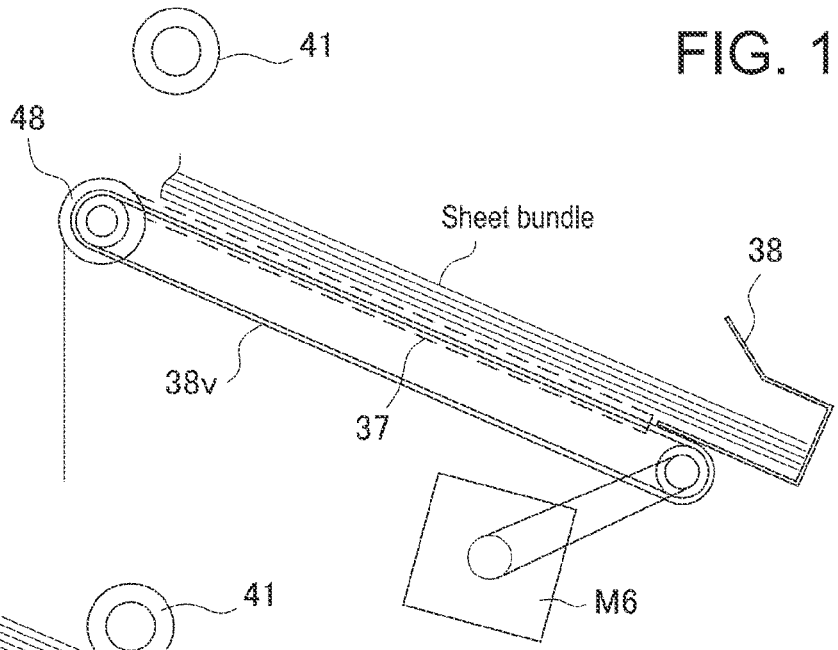
FIGS. 10A to 10C are explanatory views illustrating a sheet bundle carry-out mechanism in the apparatus of FIG. 2.
Figure 10B:
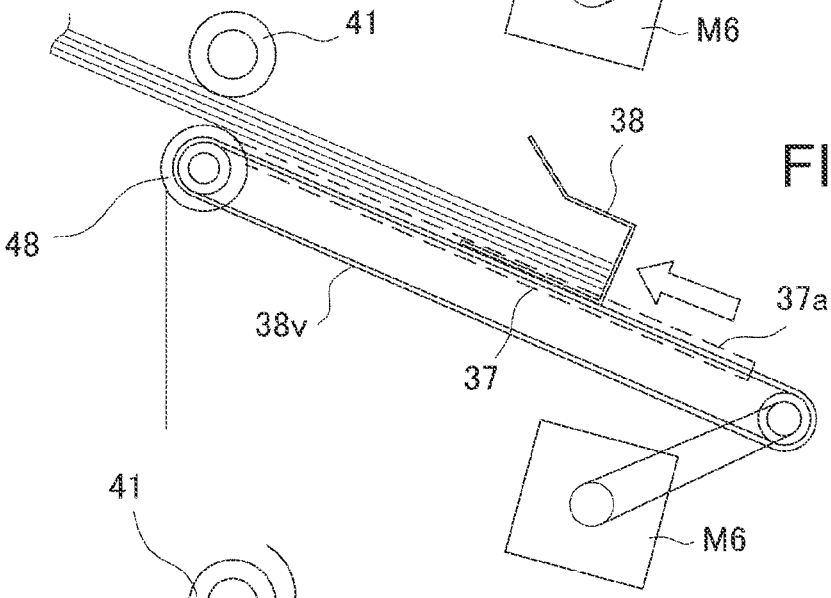
Figure 10C:
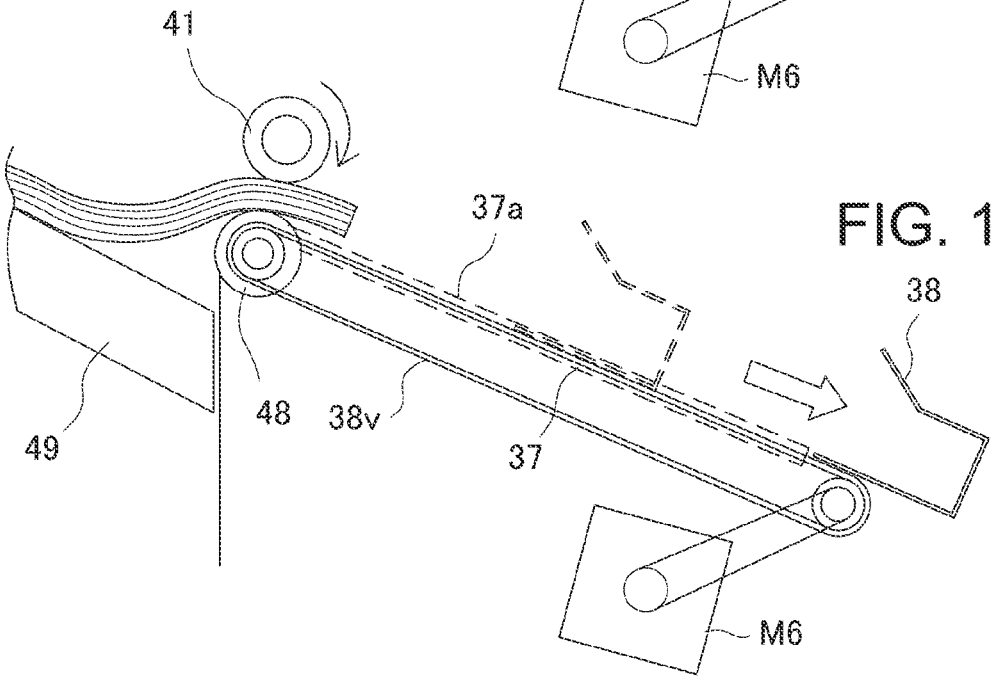

FIGS. 10A to 10C illustrate the sheet bundle carry-out mechanism. A conveying unit is constituted by a push-out projection 38 for conveying sheets along the processing tray 37 from the binding position (processing position) located on the upstream side to the stack tray (first tray) 49 located on the downstream side, a conveying belt 38*v* for moving the push-out projection 38, and a drive motor M6 therefor. The driven roller 48 is disposed at the discharging port of the processing tray 37 (boundary between the sheet placing surface 37*a* and the first tray 49). The elevating roller 41 configured to be brought into contact with the driven roller 48 is disposed with the abovementioned configuration so as to be opposed thereto. Thus, the driven roller 48 and elevating roller 41 constitute a carry-out roller unit.

Thus, as described above, the conveying units 38 and 38*v* for pushing out a sheet bundle from the upstream side to the downstream side and the carry-out roller units 48 and 41 for nipping and carrying out the sheet bundle are disposed at the processing tray 37. FIG. 10A illustrates a state where a sheet bundle is located at the binding position on the processing tray 37. At this time, the conveying units 38, 38*v* and carry-out roller units 48, 41 are brought into an operating state. FIG. 10B illustrates a midstream state of conveying the sheet bundle from the processing position to the downstream side. The sheet bundle is conveyed to the downstream side by the movement of the push-out projection 38 and rotation of the carry-out roller units 48 and 41. FIG. 10C illustrates a state immediately before the sheet bundle is carried out onto the first tray 49 on the downstream side. On the processing tray 37, the sheet bundle is conveyed slowly (at low speed) to the downstream side by the rotation of the carry-out roller units 48 and 41. At this time, the push-out projection 38 is kept waiting at the illustrated position and returned to the initial position (moved rearward).

[Structure of Fold Roller Unit]

The fold roller unit 64 for folding a sheet bundle and the fold blade 65 for inserting the sheet bundle to a nip position of the fold roller unit 64 are provided at a fold position Y set downstream of the second processing part B2.

The pair of fold rollers 64*a* and 64*b* are formed of a material having a relatively large friction coefficient, such as a rubber roller. This is to convey a sheet in the rotational direction while folding the sheet with soft material such as rubber. The pair of fold rollers 64*a* and 64*b* may be formed by performing lining on a rubber material.

The pair of fold rollers 64*a* and 64*b* are positioned at the protruded side of the curved or bent guide member 66. The fold blade 65 having a knife edge is provided at a position opposed to the fold rollers 64*a* and 64*b* so as to sandwich a sheet bundle supported by the guide member.

[Sheet Bundle Fold Finishing Mode]

In this mode, the image forming apparatus A forms images on sheets, and the sheet post-processing apparatus B performs finishing into a booklet. A sheet fed to the sheet carry-in path 28 is guided to the sheet discharge roller 36. The control CPU 95 stops the sheet discharge roller 36 with reference to a detection signal from the sheet sensor S1 indicating that the sheet rear end has passed through a path switching piece and then reversely rotates the sheet discharge roller 36. Accordingly, the sheet entering the sheet carry-in path 28 is reversed in the conveying direction and is carried in to the second sheet discharge path 32 through the path switching piece. Then, the sheet is guided to the guide member 66 by the conveying roller disposed in the path.

The control CPU 95 moves the regulating stopper 67 at the timing when the sheet is carried in to the guide member 66 from the second sheet discharge path 32. Then, the entire sheet is supported by the guide member 66.

Upon receiving a job completion signal, the control CPU 95 moves the regulating stopper 67 to set the sheet center at the binding position. Then, the control CPU 95 operates the center-binding stapling unit 63 to perform staple binding at one position or a plurality of positions around the sheet center. With a completion signal of the operation, the control CPU 95 moves the regulating stopper 67 to set the sheet center at the fold position Y, performs folding processing for the sheet bundle, and carries out the resultant sheet bundle onto the second stack tray 61.

[Control Configuration]

Figure 11:
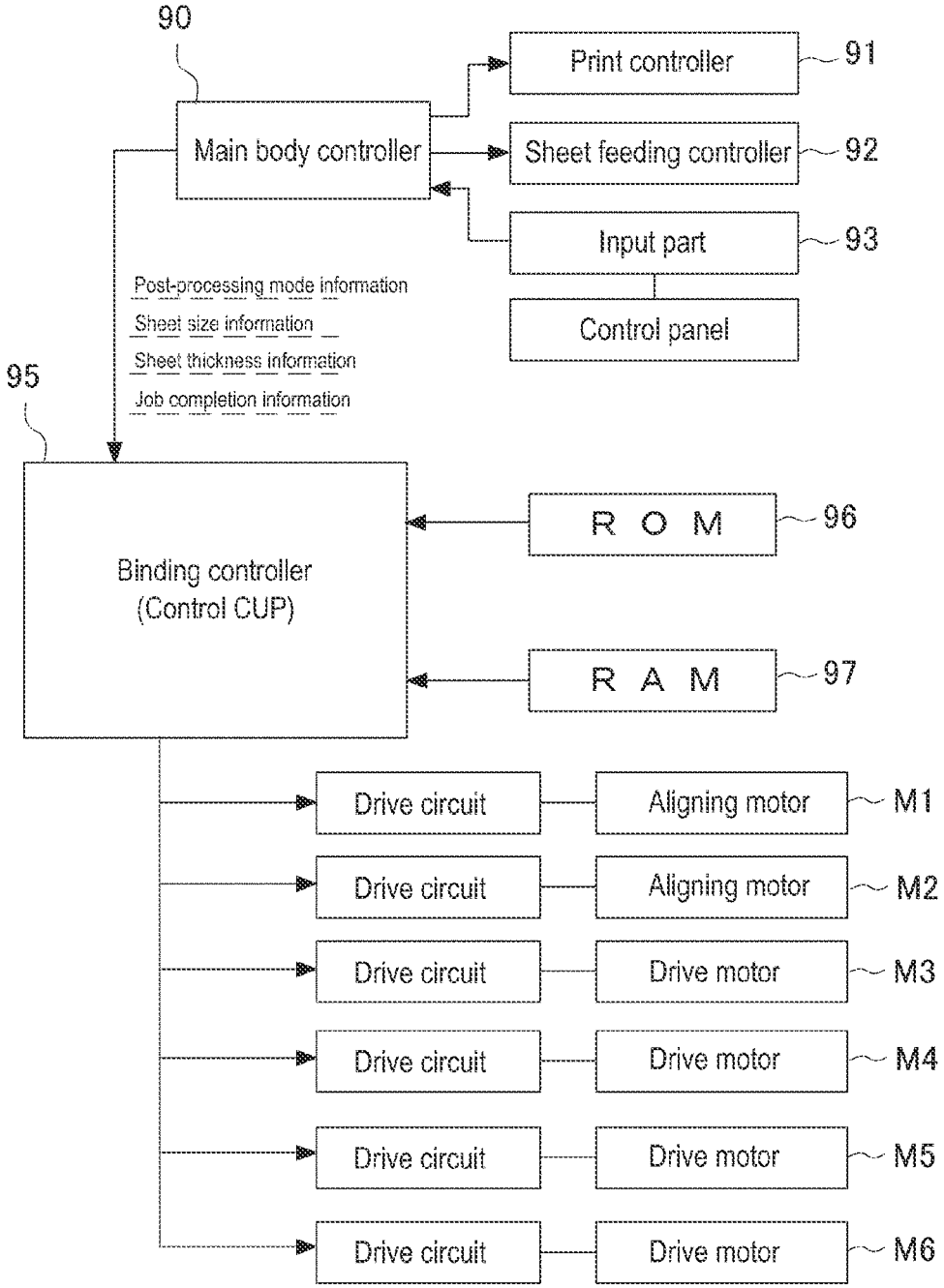
FIG. 11 is a block diagram illustrating the control configuration of the apparatus of FIG. 1.

A control configuration of the image forming system illustrated in FIG. 1 will be described with reference to FIG. 11. The image forming system illustrated in FIG. 11 includes a controller (hereinafter, called a main body controller) 90 for the image forming apparatus A and a controller (hereinafter, called a binding processing controller) 95 for the sheet post-processing apparatus B. The main body controller 90 includes a print controller 91, a sheet feed controller 92, and an input part (control panel) 93.

Setting of an image forming mode and a post-processing mode is performed on the input part (control panel) 93. The image forming mode includes setting of modes such as color/monochrome printing and double-face/single-face printing and image forming conditions such as a sheet size, sheet quality, the number of copies, and enlarged/reduced printing. The post-processing mode includes setting of a printout mode, a staple binding processing mode, an eco-binding processing mode, and a jog sorting mode. Further, the illustrated apparatus includes a manual binding mode. In this mode, a sheet bundle binding operation is performed offline separately from the main body controller 90 for the image forming apparatus A.

The main body controller 90 transfers, to the binding processing controller 95, the selection of the post-processing mode and data such as the number of sheets, the number of copies, and the thickness of sheets on which images are to be formed. Further, the main body controller 90 transfers a job completion signal to the binding processing controller 95 each time when image forming is completed.

The following describes the above post-processing mode. In the printout mode, a sheet from the sheet discharge port 35 is stored on the stack tray 49 through the processing tray 37 without being subjected to binding processing. In this case, sheets are overlapped and stacked on the processing tray 37, and the resultant sheet bundle is carried out onto the stack tray 49 according to a jog completion signal from the main body controller 90.

In the staple binding processing mode, sheets from the sheet discharge port 35 are stacked and collated on the processing tray 37, and the resultant sheet bundle is subjected to binding processing and then stored on the stack tray 49. In this case, sheets on which images are to be formed are specified by an operator basically to have the same thickness and size. In the staple binding processing mode, one of the multi-binding, right corner binding, and left corner binding is selected and specified. The binding positions thereof are as described above.

In the jog sorting mode, sheets are sorted into a group whose sheets having images formed by the image forming apparatus A are offset and stacked and a group whose sheets are stacked without being offset. An offset sheet bundle and a non-offset sheet bundle are alternately stacked on the stack tray 49.

[Manual Binding Mode]

A manual setting part where an operator sets a sheet bundle to be subjected to binding processing is provided at the apparatus front side of the external casing. A sensor to detect a set sheet bundle is disposed at the setting surface of the manual setting portion. According to a signal from the sensor, the binding processing controller 95 to be described later causes the stapling unit 47 to move to the manual binding position. Then, when an operation switch is depressed by an operator, the binding processing is performed.

Thus, the manual binding mode is controlled offline from the binding processing controller 95 and main body controller 90; however, in a case where the manual binding mode and staple binding mode are to be performed concurrently, either mode is set to have priority.

[Binding Processing Controller (Controller)]

The binding processing controller 95 causes the sheet post-processing apparatus B to operate in accordance with the post-processing mode set by the image forming controller 90. The illustrated binding processing controller 95 is constituted by a control CPU (hereinafter, simply called a controller) to which a ROM 96 and a RAM 97 are connected. The control CPU 95 performs a sheet discharge operation to be described later according to control programs stored in the ROM 96 and control data stored in the RAM 97. Thus, drive circuits for all the above-mentioned drive motors are connected to the control CPU 95, and start, stop, and forward-reverse rotation of the motors are controlled thereby.

[Sheet Discharge Operation Mode]

The controller (main body controller) 90 for the image forming apparatus A sets a post-processing (finishing) mode of image-formed sheets concurrently with image forming conditions. The illustrated apparatus can be set to any of a staple binding mode, an eco-binding mode, a jog sorting mode, a bookbinding mode, a printout mode, an interruption mode, and a manual binding mode. In the following, operations of the respective modes will be described.

Figure 12:
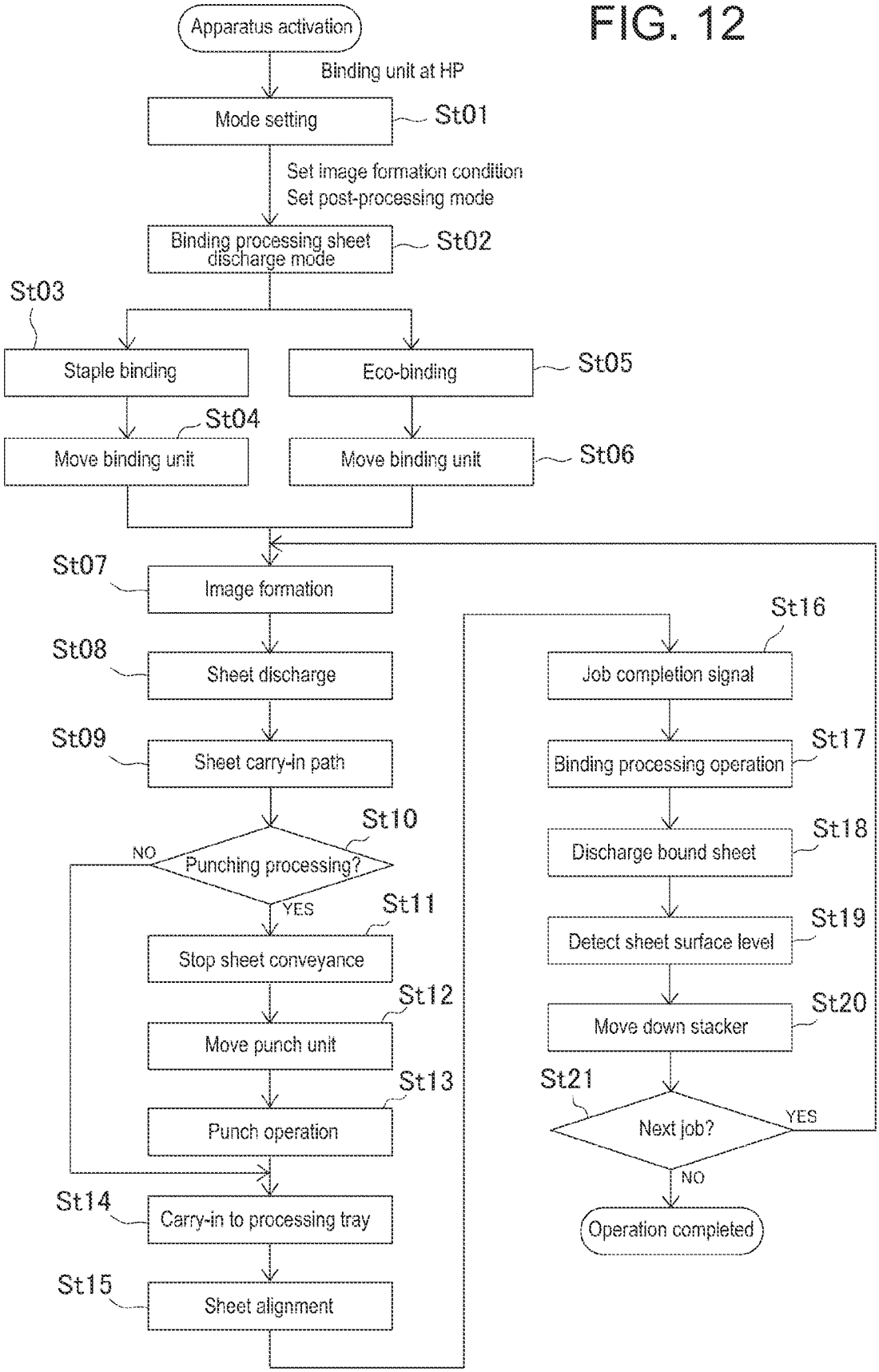
FIG. 12 is a flowchart of binding processing and sheet discharging operation.
Figure 13A:
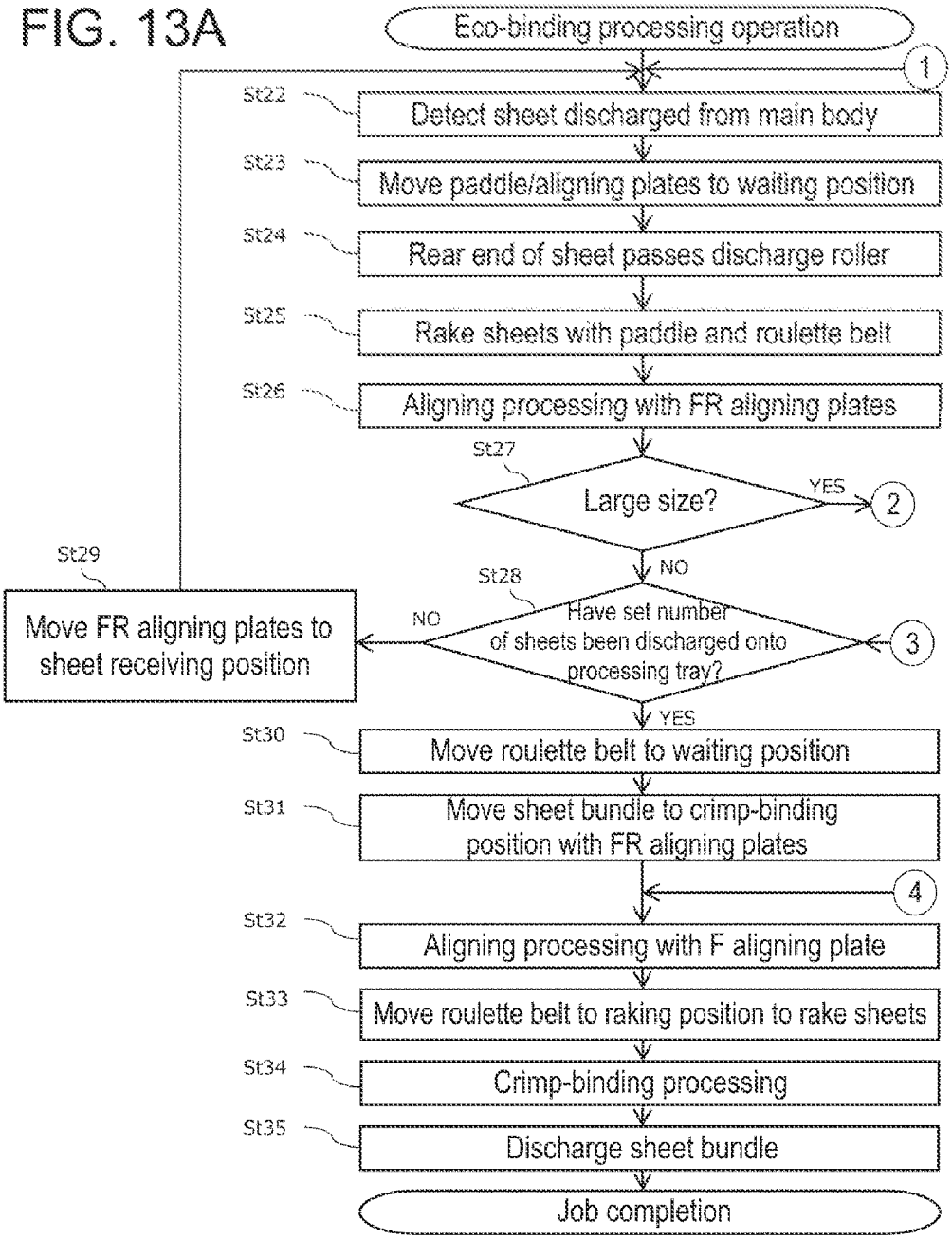
FIGS. 13A and 13B are crimp-binding operation flows in the apparatus of FIG. 1.
Figure 13B:
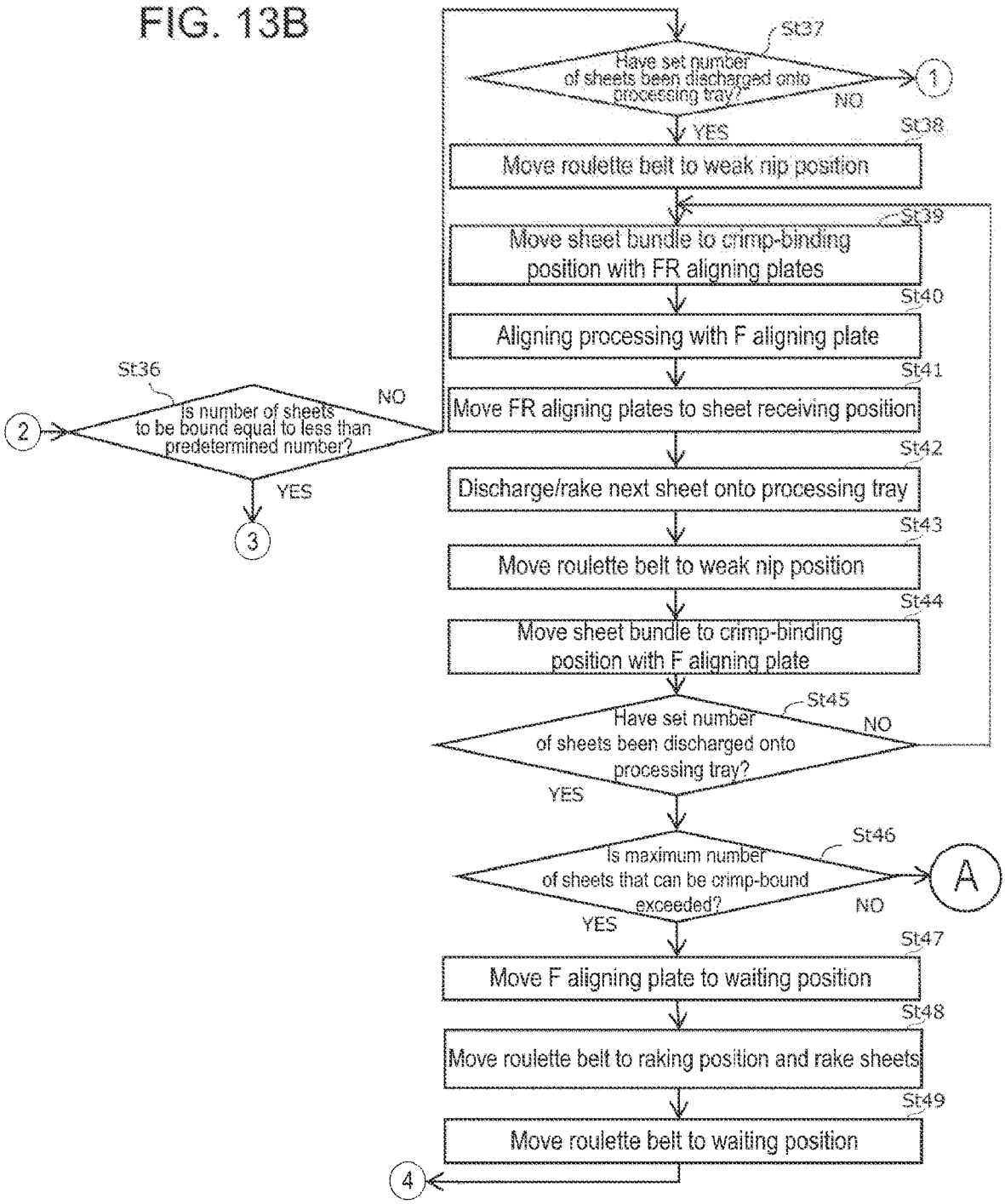

FIG. 12 is an explanatory view of an operation flow to store a sheet bundle stacked on the processing tray 37 of the first processing part B1, on the first tray 49 located on the downstream side, after the sheet bundle is staple-bound or eco-bound. FIGS. 13A and 13B are explanatory views of a sheet discharge mode to perform jog sorting for each bundle, which illustrates an operation flow to store sheets on the third tray 71 located on the downstream side, after the sheets are offset in a direction perpendicular to the sheet discharge direction by a jog mechanism (roller shift mechanism; not illustrated) of the third processing part B3 (sheet carry-in path). FIG. 14 is an explanatory view of the bookbinding discharge mode to perform bookbinding finishing for sheets at the second processing part B2.

[Staple Binding Mode and Eco-Binding Mode at First Processing Part]

Referring to FIG. 12, setting of the post-processing mode is performed on the control panel 93 or the like of the image forming apparatus A (St01). Based on the post-processing mode setting information, the controller 95 for the sheet post-processing apparatus B causes the binding unit to move when the staple binding processing is designated (St04). Further, the binding unit is moved as well when the eco-binding process is designated (St05).

For the staple binding processing, the first binding unit 47 is moved to the set binding position Cp1, and the second binding unit 51 is moved to the second waiting position Wp2. When the unit position is set as a home position, the moving operation is performed after checking whether or not each unit is at the home position.

Next, the image forming apparatus A forms an image and discharges the image-formed sheet (St07, St08). The sheet post-processing apparatus B receives the image-formed sheet fed to the carry-in port 26 and conveys the sheet to the downstream side (St09). When punching processing is designated at this time (St10), the controller 95 causes the sheet to temporarily stop at a punching position (St11). Then, a punch unit 50 is moved in a direction perpendicular to the sheet discharge direction and is stopped after a specified punching position is determined by detecting the sheet side edge detected by a sensor, and a punching operation is performed (St13).

When the punching processing is not designated, the controller 95 causes the sheet to be received at the carry-in port 26 and to be conveyed to the sheet discharge port 35. Then, the sheet is carried in onto the processing tray 37 and positioned at a predetermined position by a positioning unit (St15). The controller 95 causes sheets fed to the sheet discharge port 35 to be stacked and stored on the sheet placing surface 37*a* of the processing tray 37 (St07 to St15). When a jog completion signal is received from the image forming apparatus A (St16), the controller 95 transmits a binding processing instruction signal to the first binding unit 47 or the second binding unit 51. Accordingly, the first binding unit 47 or second binding unit 51 performs the binding processing (St17).

Upon receipt of a binding processing completion signal from the first or second binding unit 47, 51, the controller 95 causes the bound sheet bundle to be stored on the first tray 49 located on the downstream side by way of the sheet bundle discharge mechanism (St18). Then, a sheet level detection sensor (not illustrated) disposed at the first tray 49 is used to detect the height of the stacked sheets. When the detection value exceeds a predetermined height, the first tray 49 is lowered (St20). Subsequently, the controller 95 determines whether or not the next job exists (St21), and the operation is completed.

[Eco Binding Mode]

The following describes in detail the operation of the NS binding (eco-binding) mode with reference to flowcharts of FIGS. 13A and 13B illustrating the eco-binding operation.

[Eco-Binding Operation]]

The eco-binding operation will be described with reference to the flowcharts of FIGS. 13A and 13B and operation views, corresponding thereto, of FIG. 14 and subsequent figures. Upon receiving, from the image forming apparatus A, a signal indicating that the crimp-binding processing is selected, the controller 95 starts the crimp-binding processing. Based on a sheet output start signal from the image forming apparatus main body or a front end detection signal from the sheet sensor S1 (St22), the paddle rotor 42 is positioned at the waiting position at least before the first sheet of the sheets to be subjected to the crimp binding is discharged onto the processing tray 37, and the side aligning units 39F and 39R are located at the waiting positions separated by a distance larger than the width of the sheet (positions outside the respective outer edges of the sheet in the sheet width direction) (St23).

Subsequently, the controller 95 causes the paddle rotor 42 to move downward from the waiting position on the upper side to the operating position at the timing when the sheet rear end has passed through the sheet discharge roller 36 (St24, FIG. 14A) and, at the same time, causes the roulette rotor 46 (roulette belt 46) to move downward from the waiting position above the sheet placing surface to the operating position on the sheet placing surface (St25). At this time, both the paddle rotor 42 and roulette rotor 46 are rotated in a direction to move the sheet in an opposite direction to the sheet discharge direction.

Figure 14A:
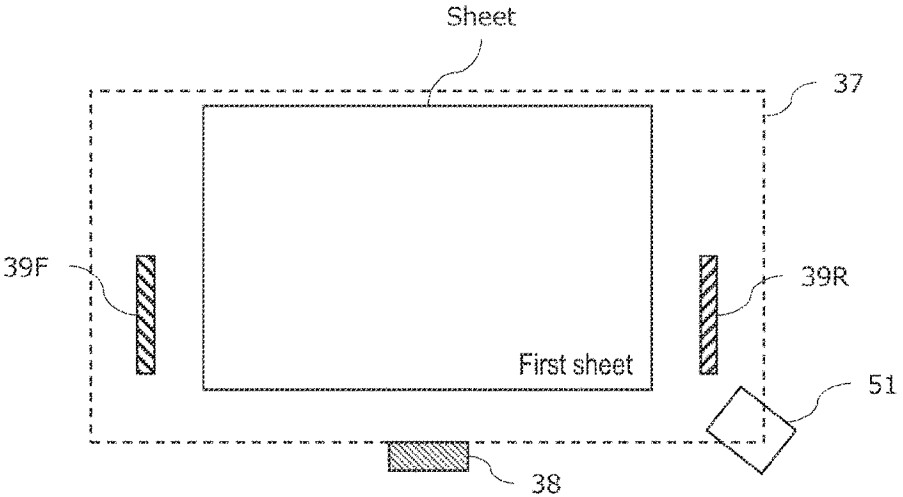
FIGS. 14A to 14D are explanatory views illustrating a crimp-binding operation (center alignment) for a small size sheet.
Figure 14B:
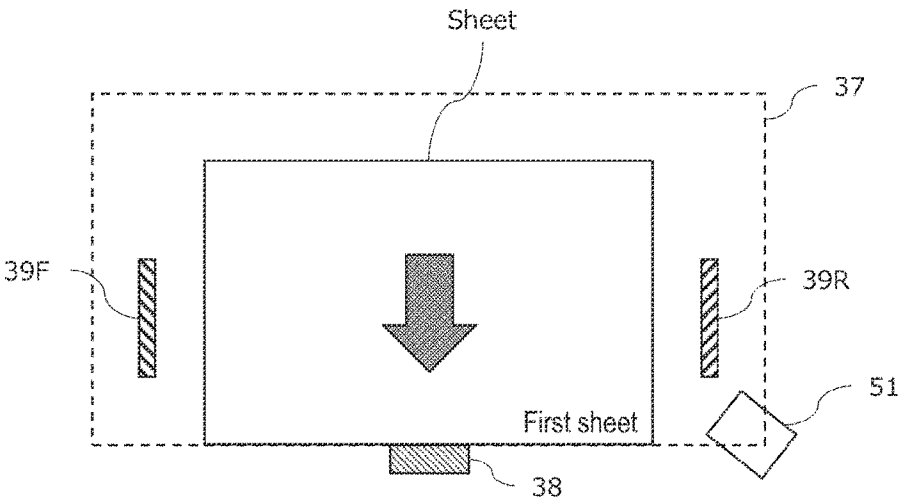
Figure 14C:
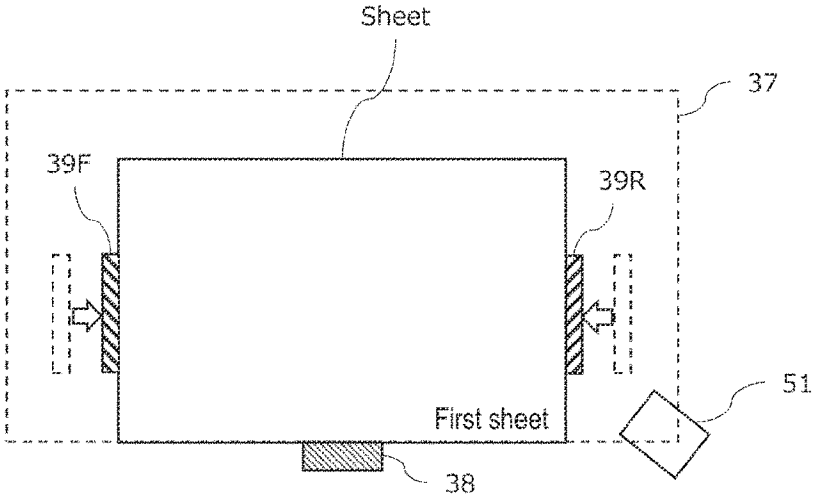
Figure 14D:
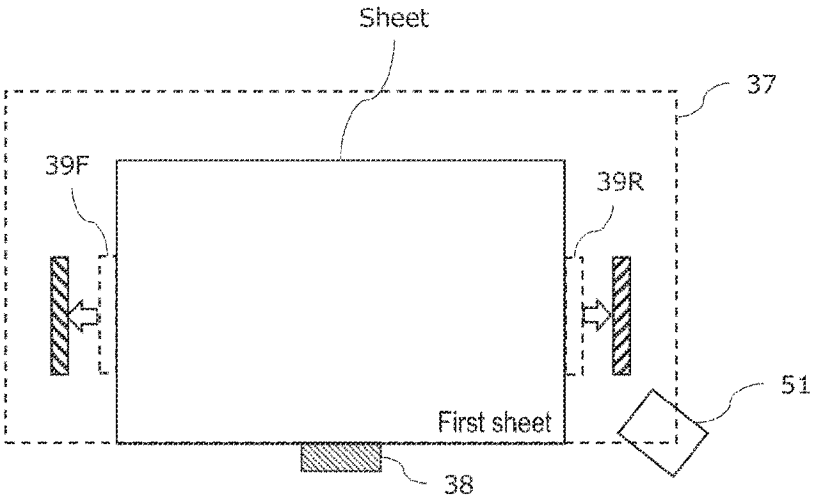

After the elapse of a predetermined period of time (estimated time taken for the sheet rear end to reach the position where it is raked by the roulette rotor 46), the controller 95 causes the paddle rotor 42 to elevate from the operating position to the waiting position. Further, after the elapse of a predetermined period of time (estimated time taken for the sheet front end to reach the rear end regulating member), the controller 95 causes the roulette rotor 46 to elevate slightly. The amount of elevation of the roulette rotor 46 is determined based on experimental values so as to reduce the pressing force against the sheet. As a result, the rear end of the sheet in the conveying direction abuts against the sheet regulating unit 38 (FIG. 14B).

Subsequently, the controller 95 performs different control operations according to the size of the conveyed sheet (St27). When the size of a sheet discharged onto the processing tray 37 is a small size (A4 size or letter size), the first sheet is aligned in center reference by the side aligning members 39F and 39R (St26, FIG. 14C). Then, for the second sheet to be conveyed onto the processing tray 37, the side aligning members 39F and 39R are moved to the sheet receiving position (St29, FIG. 14D).

Figure 15A:
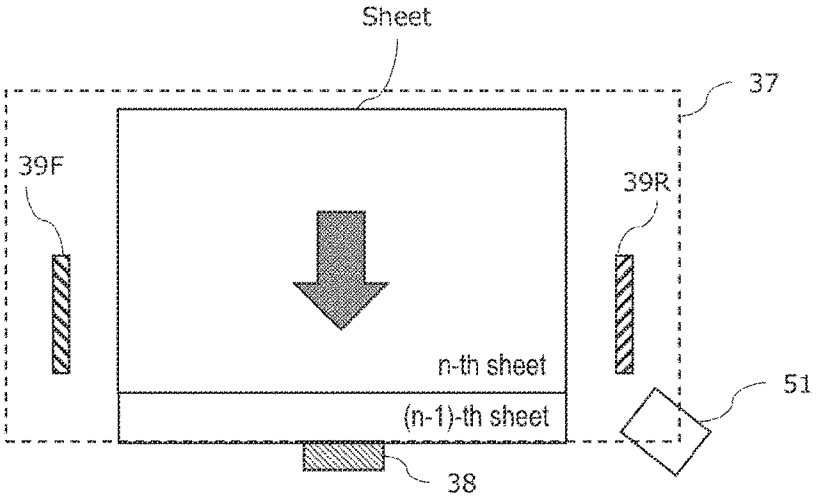
FIGS. 15A to 15D are explanatory views illustrating a crimp-binding operation (bundle shift) for a small size sheet.
Figure 15B:
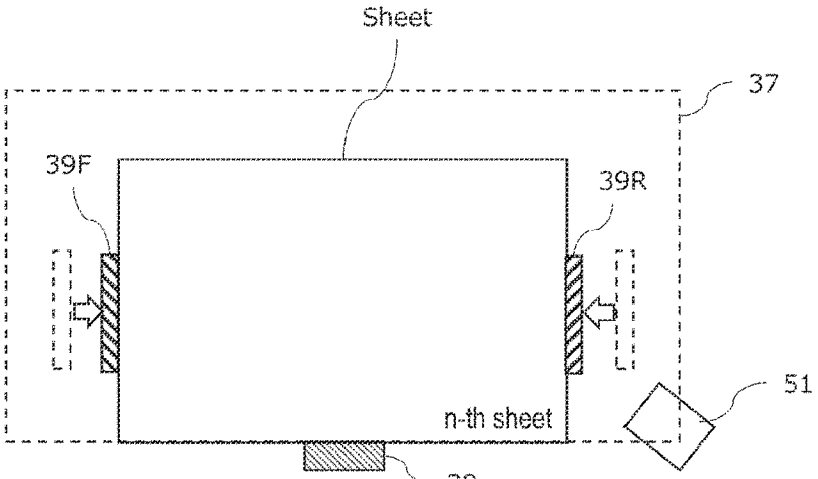

In the crimp-binding device according to the present embodiment, the maximum number of bindable sheets is set to 10, and the maximum number of sheets that can be shifted as a bundle by the side aligning members 39 is set to 10 for the small size sheet, so that it is detected whether the number of conveyed sheets reaches a set binding number n (equal to or less than 10) (St28) (or the number of sheets may be recognized by number-of-sheets information received from the image forming apparatus main body), and the above-mentioned sheet carry-out and center aligning operations are performed repeatedly until the set binding number n is reached (FIGS. 15A and 15B, St24 to St29).

Figure 15C:
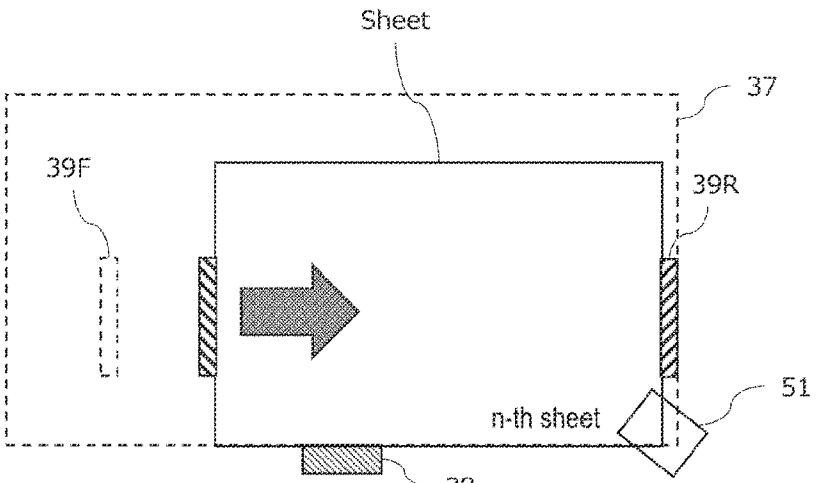

Then, the controller 95 causes the roulette rotor 46 to move to the waiting position (position not contacting the sheet bundle) (St30) and causes the sheet bundle to move to the rear side with the sheet bundle sandwiched by the side aligning members 39F and 39R until the sheet bundle reaches the crimp-binding position (St31, FIG. 15C).

Figure 15D:
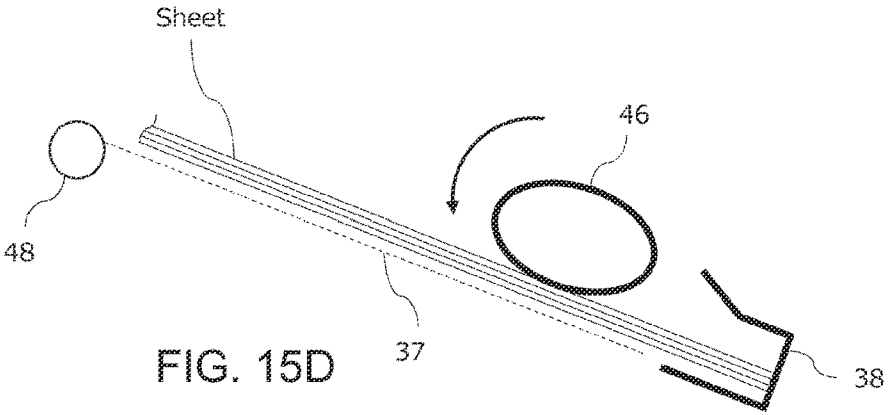
Figure 16A:
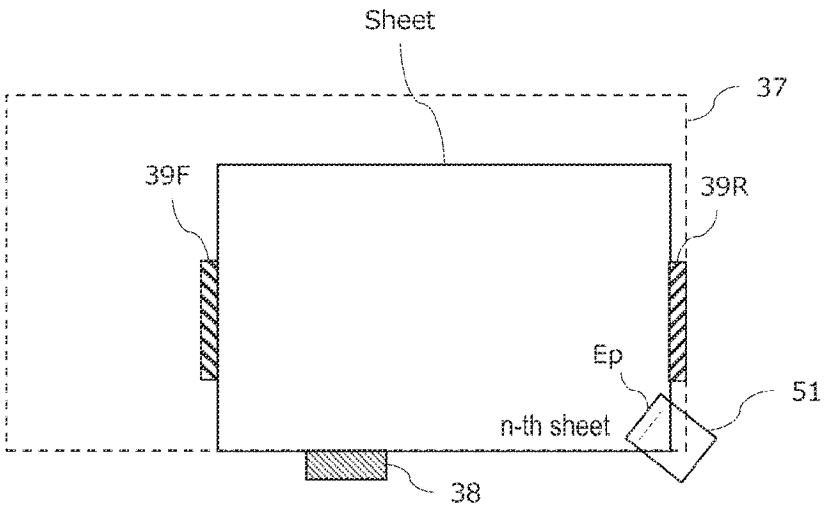
FIGS. 16A and 16B are explanatory views illustrating a crimp-binding operation (binding operation and discharge) for a small size sheet.
Figure 16B:
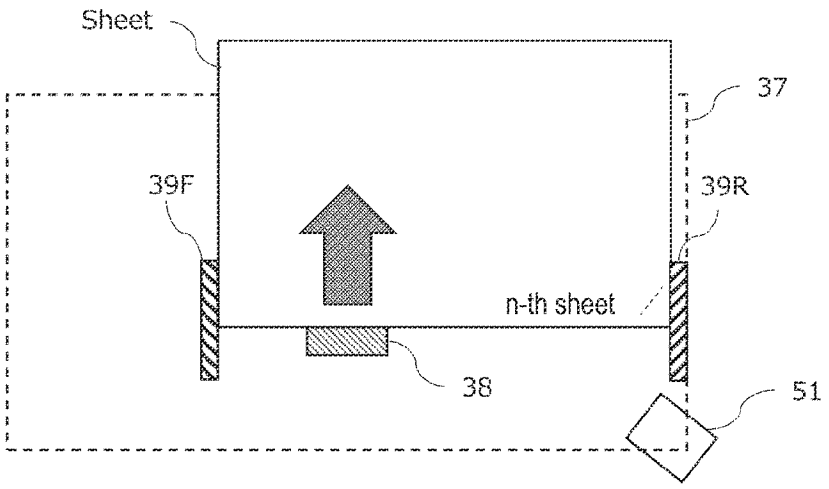

The sheet bundle moved to the crimp-binding position is aligned widthwise by the side aligning member 39F (St32), and then the roulette rotor 46 is lowered from the waiting position above the sheet placing surface to the operating position on the sheet placing surface (St33). The roulette rotor 46 is then rotated in a direction opposite to the sheet discharge direction to position the sheet bundle (FIG. 15D), followed by crimp-binding processing by the crimp-binding unit 51 (St34, FIG. 16A). The bound sheet bundle is then moved downstream in the sheet conveying direction to complete the sheet discharge operation (St35, FIG. 16B). At this time, the side aligning members 39F and 39R are positioned at the aligning positions or positions slightly retracted from the sheet edges.

The following describes a case where the size of a sheet discharged onto the processing tray 37 is a large size (A3 size or ledger size) and where the set binding number is equal to or less than the maximum number (in the present embodiment, five) of sheets that can be shifted as a bundle for the large size sheet (St36).

Figure 17A:
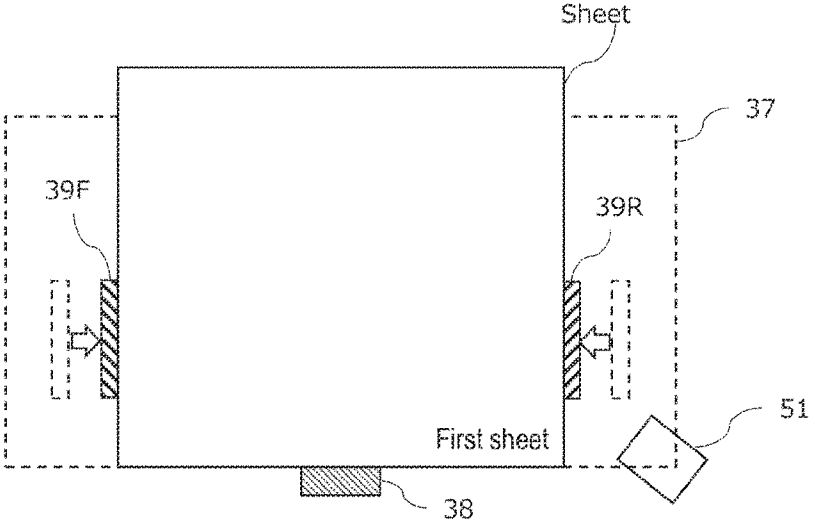
FIGS. 17A to 17D are explanatory views illustrating a crimp-binding operation (bundle shift) for a large size sheet whose number is equal to or less than a predetermined number.
Figure 17B:
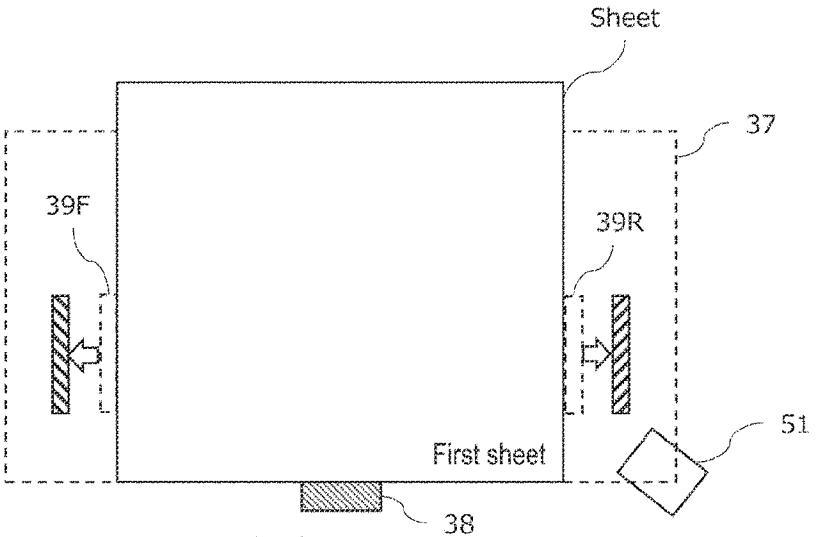
Figure 17C:
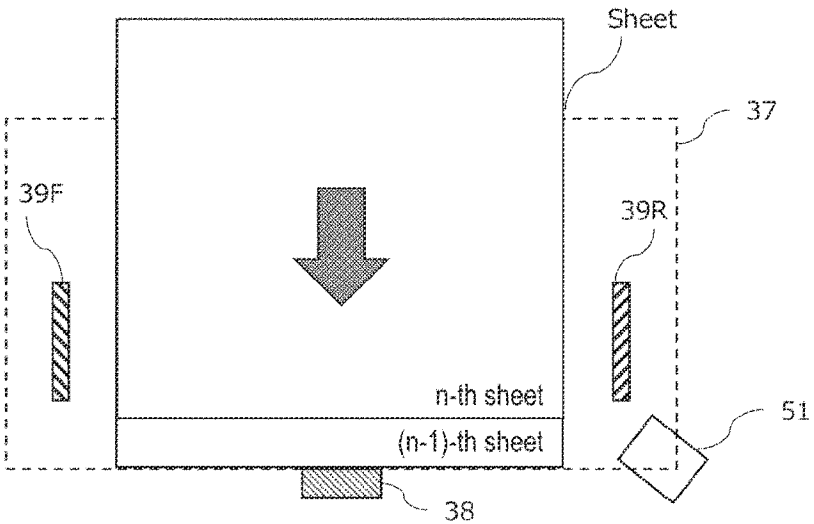
Figure 17D:
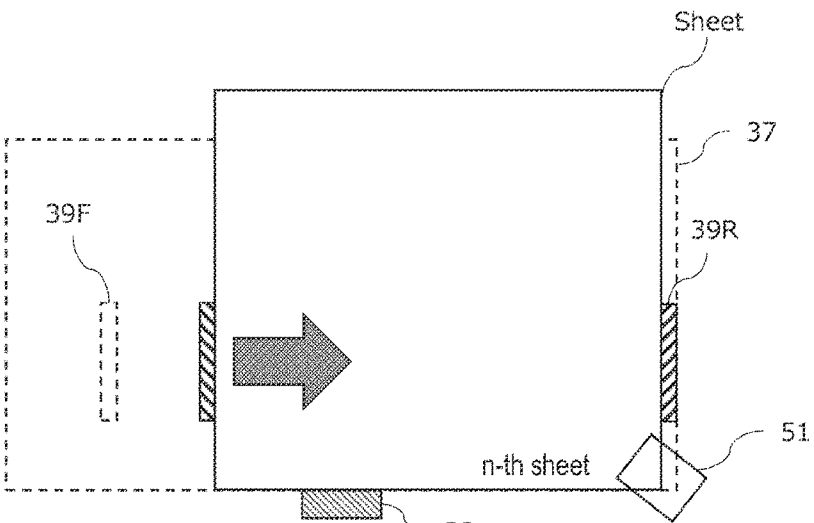
Figure 18A:
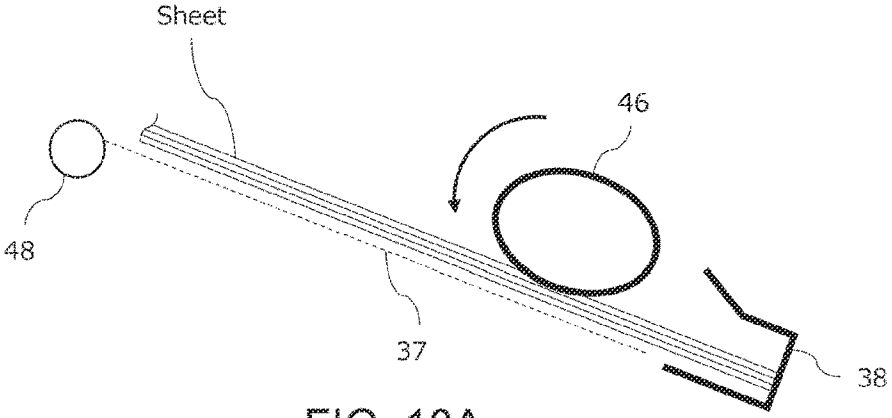
FIGS. 18A to 18C are explanatory views illustrating a crimp-binding operation (binding operation and discharge) for a large size sheet whose number is equal to or less than a predetermined number.
Figure 18B:
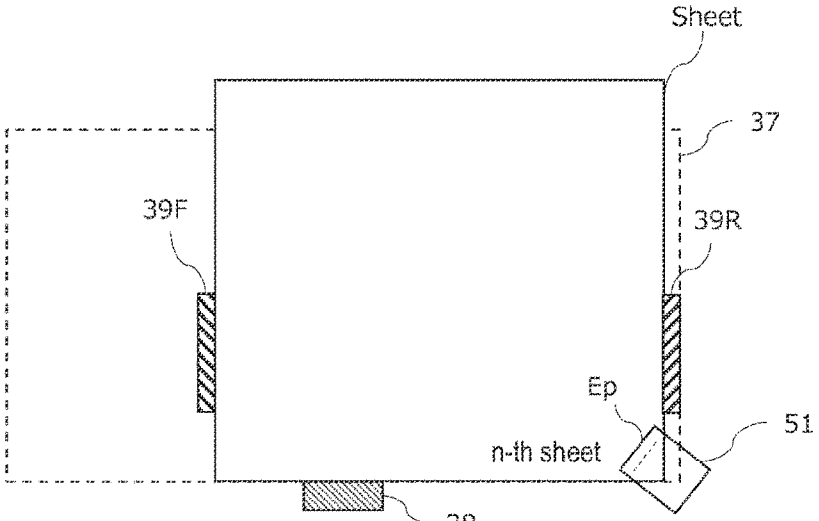
Figure 18C:
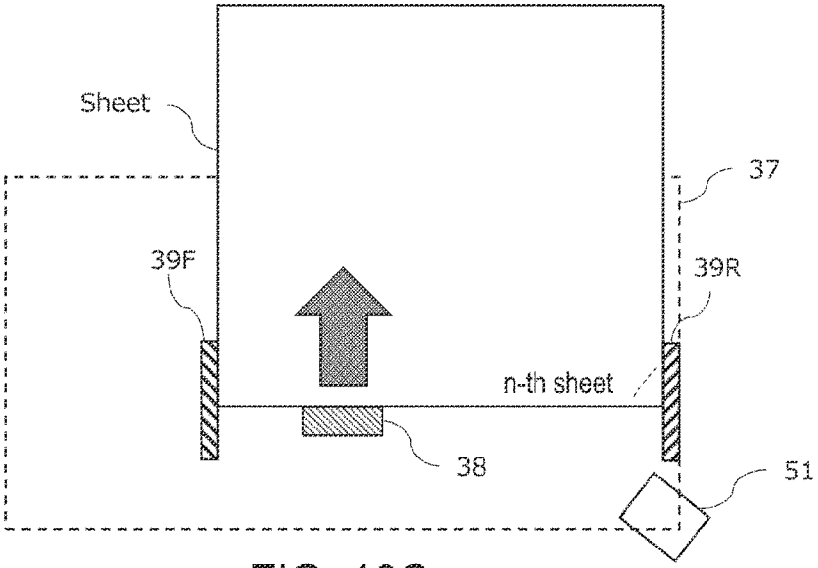

The controller 95 causes the first sheet discharged onto the processing tray 37 to be aligned in center reference by the side aligning members 39F and 39R (St26, FIG. 17A). Then, for the second sheet to be conveyed onto the processing tray 37, the side aligning members 39F and 39R are moved to the sheet receiving position (St29, FIG. 17B).

In the crimp-binding device according to the present embodiment, the maximum number of bindable sheets is set to 10 as described above. To shift the 10 large size sheets as a bundle, a large drive source is required for a moving mechanism for moving the aligning plates, so that, in the present embodiment, the maximum number of sheets that can be shifted as a bundle is set to five for the large size sheet. Then, it is detected whether the number of conveyed sheets reaches a set binding number n (equal to or less than five) (St28), and the above-mentioned sheet carry-out and center aligning operations are performed repeatedly until the set binding number n is reached (St24 to St29). The subsequent operation is the same as that for the small size sheet (St30 to St35, FIGS. 17C to 17D, FIGS. 18A to 18C).

In the present embodiment, the number of sheets set for processing the large size sheet is five, which is determined based on a value of about ½ of a load applied to the aligning plates when 10 small size sheets are shifted as a bundle, and it is possible to set a table defining the number of sheets set for processing the large size sheet more finely based on the size or basis weight so as to perform various different operations. When the number of sheets stacked in center reference exceeds the maximum number of sheets that can be crimp-bound, the crimp-binding operation is cancelled, and the target sheet bundle is discharged without being subjected to the crimp-binding.

The following describes a case where the sheet discharged onto the processing tray 37 is a large-size sheet and where the set binding number exceeds the maximum number of sheets that can be shifted as a bundle for the large size sheet (St37).

Figure 19A:
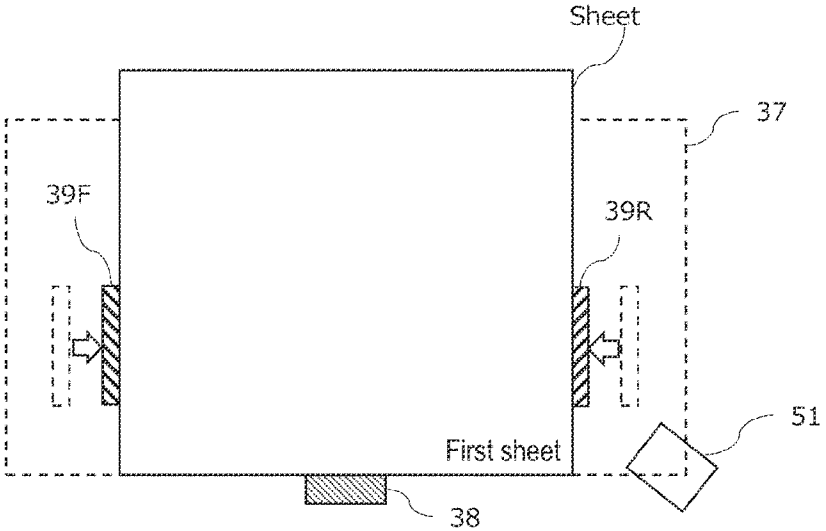
FIGS. 19A to 19D are explanatory views illustrating a crimp-binding operation (center alignment) for a large size sheet whose number exceeds a predetermined number.
Figure 19B:
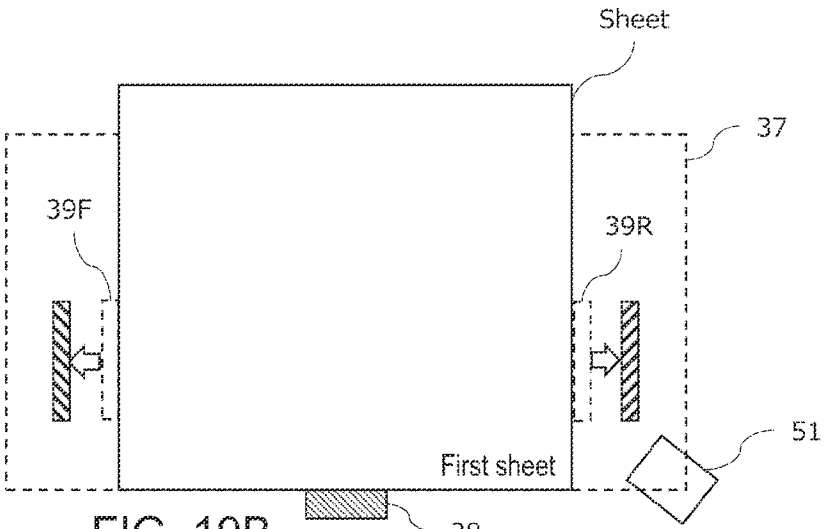
Figure 19C:
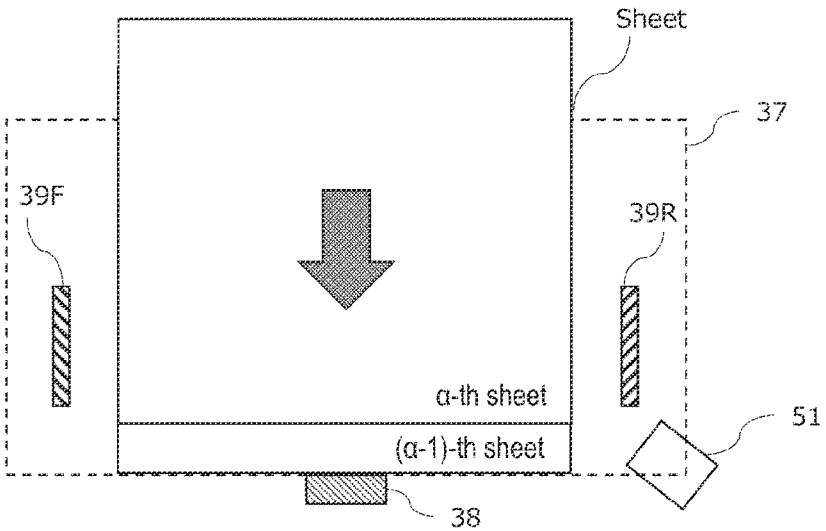
Figure 19D:
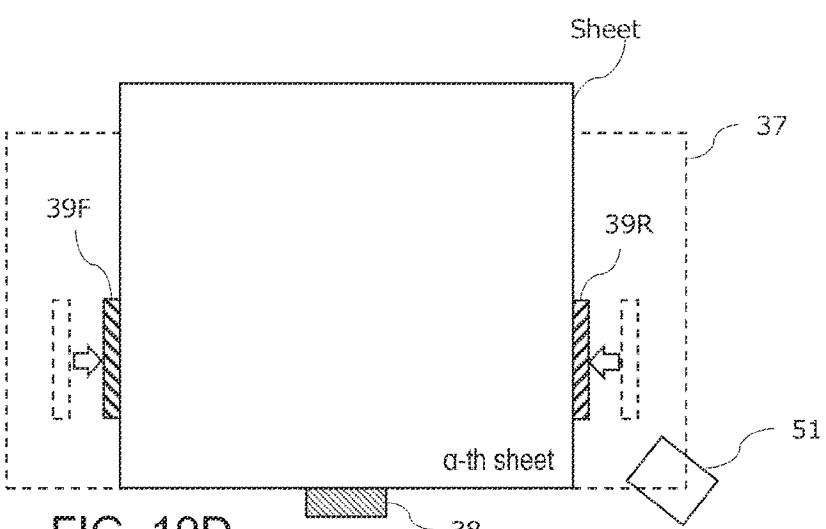

The controller 95 causes the first sheet discharged onto the processing tray 37 to be aligned in center reference by the side aligning members 39F and 39R (St26, FIG. 19A). Then, for the second sheet to be conveyed onto the processing tray 37, the side aligning members 39F and 39R are moved to the sheet receiving position (St29, FIG. 19D).

The maximum number of sheets that can be crimp-bound in the crimp-binding device according to the present embodiment is 10 as described above, while the maximum number of sheets that can be shifted as a bundle is five for the large size sheet. It is preferable in terms of alignment performance that a sheet bundle is formed in center alignment if possible, followed by bundle shifting, so that sheet carry-out and center aligning operations are performed repeatedly as in the case of the above-described control until the set binding number n reaches five (St24 to St29, FIGS. 19C and 19D).

Figure 20A:
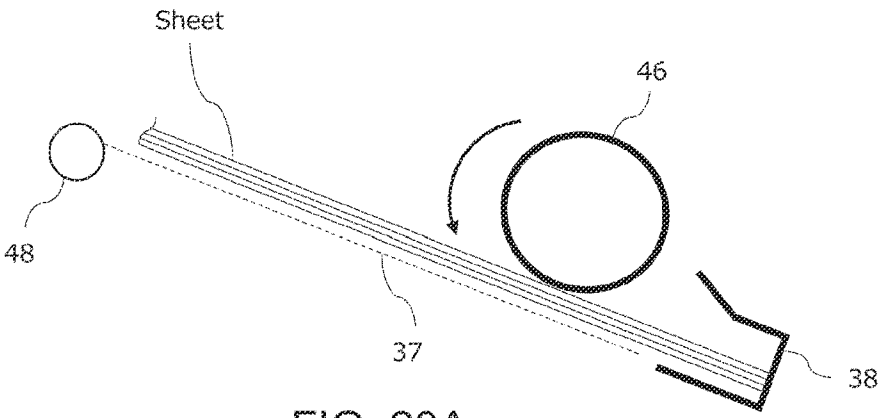
FIGS. 20A to 20D are explanatory views illustrating a crimp-binding operation (bundle shift/discharge of succeeding sheet) for a large size sheet whose number exceeds a predetermined number.
Figure 20B:
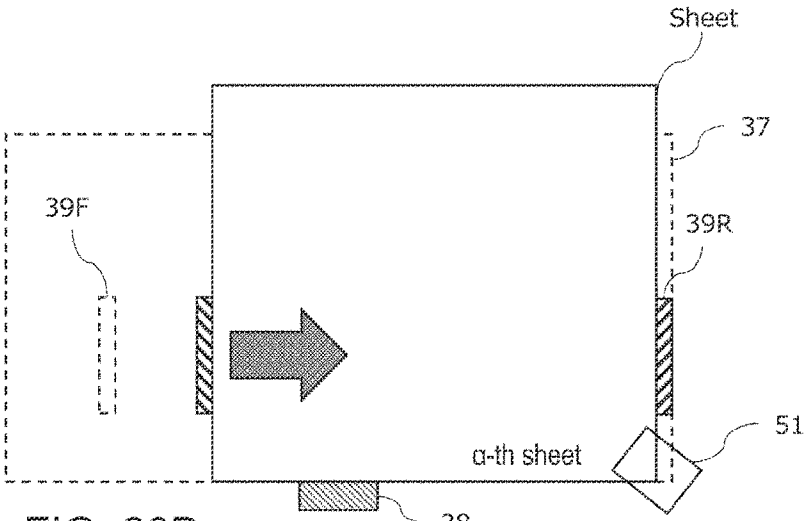
Figure 20C:
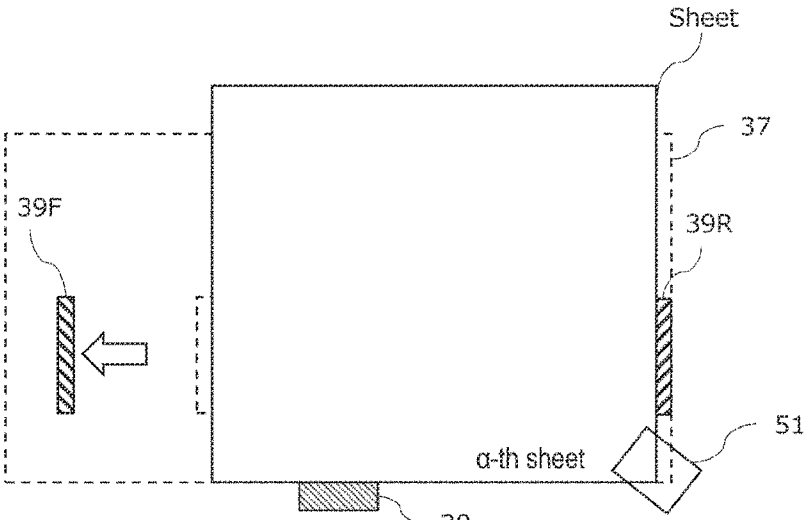
Figure 20D:
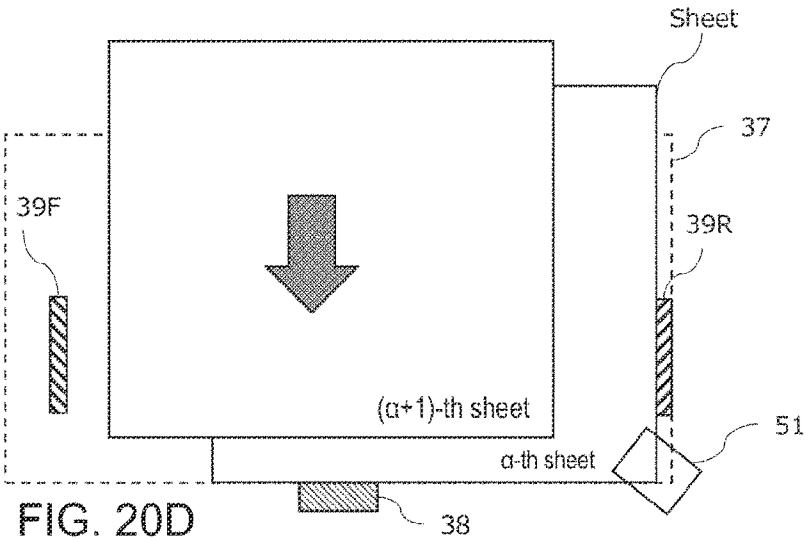
Figure 21C:
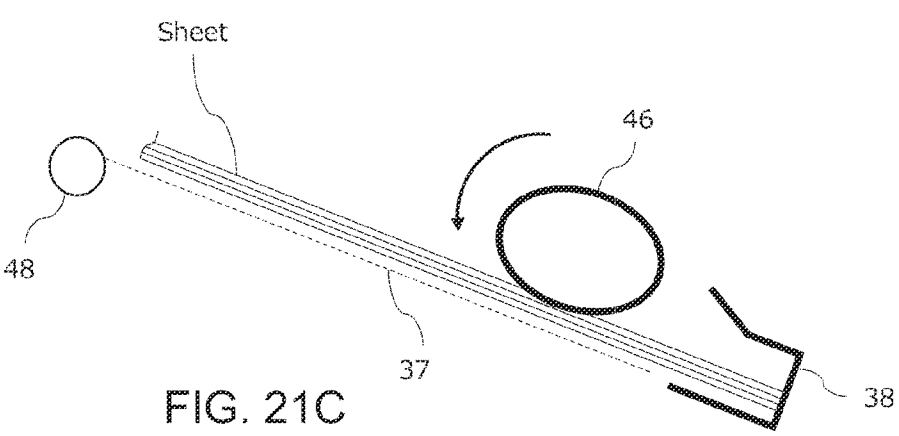
FIGS. 21A to 21D are explanatory views illustrating a crimp-binding operation (binding operation) for a large size sheet whose number exceeds a predetermined number.
Figure 21D:
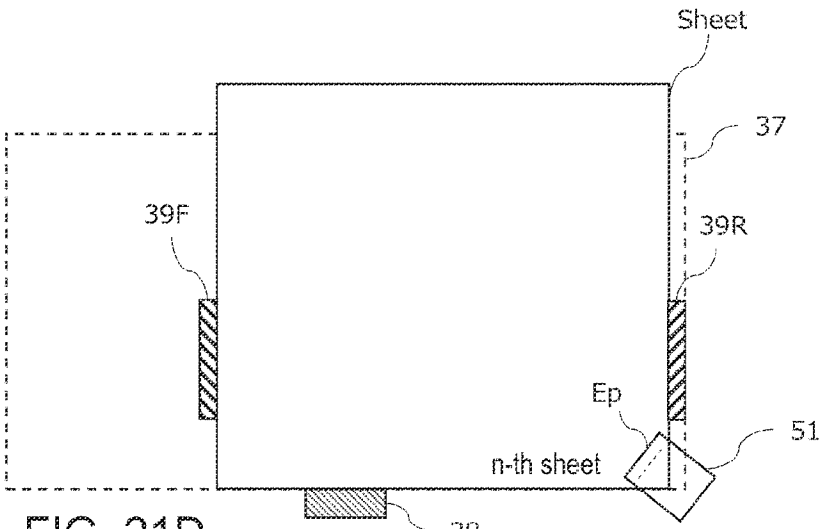
Figure 21A:
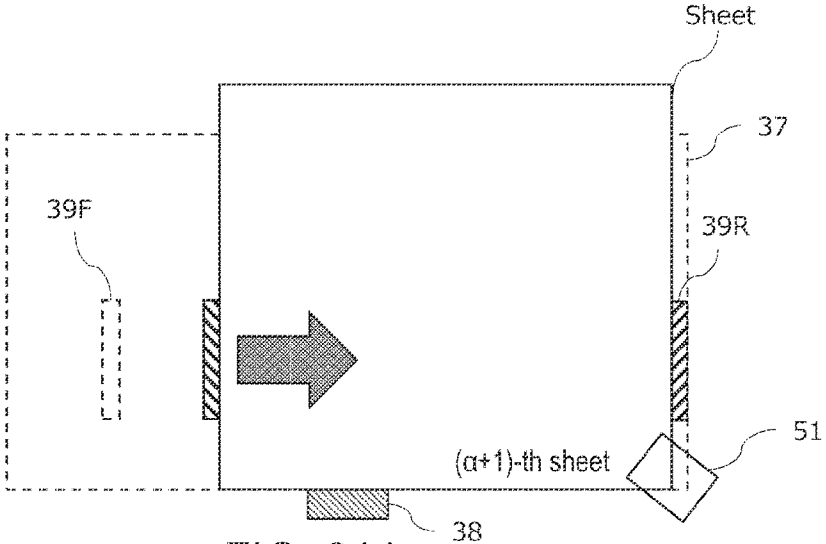
Figure 21B:
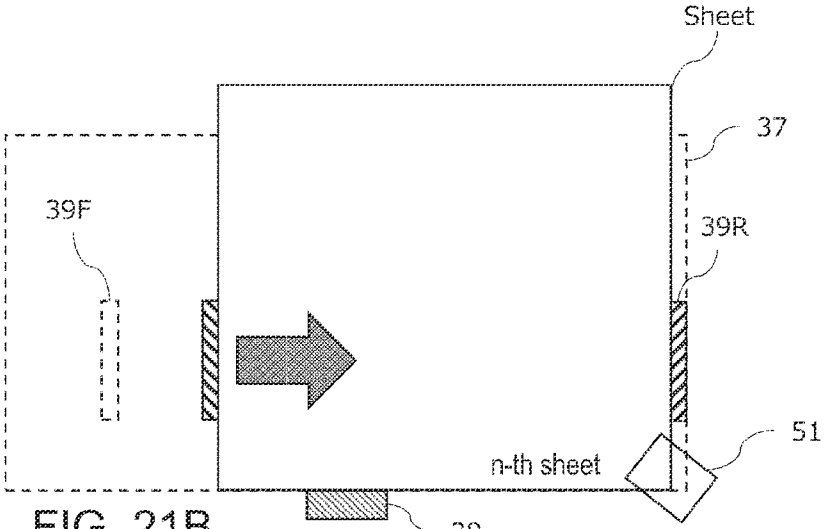

Subsequently, the controller 95 causes the roulette rotor 46 to a weak nip position (position between the waiting position and the raking position, at which the roulette rotor slightly contacts a sheet) (St38, FIG. 20A) and causes the sheet bundle to move to the rear side with the sheet bundle sandwiched by the side aligning members 39F and 39R until the sheet bundle reaches the crimp-binding position (St39, FIG. 20B). The movement of the roulette roller 46 to a weak nip position is performed so as to prevent the sheets from skewing since the sheet bundle is shifted only by the side aligning member 39F with the side aligning member 39R fixed to the bundle shift position. By doing so, the roulette roller 46 contacts the sheet with a less force than at the raking position, so that it is also possible to prevent displacement of the sheet due to excessive raking. The sheet bundle moved to the crimp-binding position is aligned widthwise at the crimp-binding position Ep by moving the side aligning member 39F toward the side aligning member 39R (St40). Then, the side aligning member 39F is moved to the sheet receiving position with the side aligning member 39R left at the crimp-binding position Ep, to receive the next sheet (St41, FIG. 20C). Each time the next sheet is conveyed onto the processing tray 37 (St42, FIG. 29H), it is moved to the crimp-binding position Ep by the side aligning member 39F (single-sheet shifting operation) (St44, FIG. 21A). At this time, the roulette rotor 46 is moved to the above-mentioned weak nip position (St43, FIG. 20A). Then, it is detected whether the set binding number n (n 10) is reached (St45), and conveyance to the processing tray and movement to the crimp-binding position are repeatedly performed for each sheet until the set binding set number n is reached (St41 to St45).

In the present embodiment, the roulette rotor 46 is always positioned at the weak nip position. What is important Here is to perform a raking operation with the roulette rotor 46 every time one sheet is moved, and so various operations can be selected, such as moving the roulette rotor 46 between the waiting position and the raking position and between the weak nip position and the raking position.

Each sheet is moved to the crimp-binding position Ep one by one, and each time the movement is performed, it is confirmed whether the binding number is within the maximum number of sheets (in the present embodiment, 10) that can be crimp-bound (St46) (canceling operation will be described later).

Figure 22:
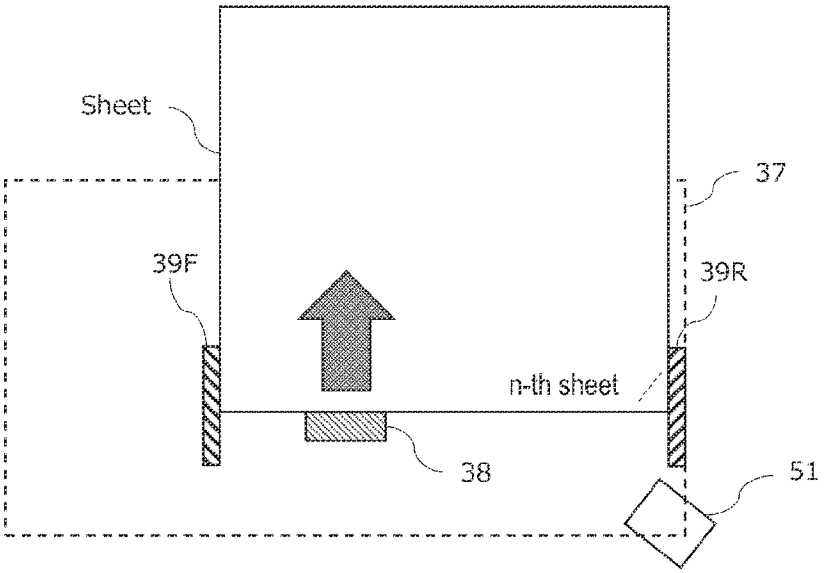
FIG. 22 is an explanatory view illustrating a crimp-binding operation (discharge) for a large size sheet whose number exceeds a predetermined number.

Then, the controller 95 causes the side aligning member 39F to move to a position separated from a sheet bundle (constituted by sheets whose number is within the set binding number n) (St47) and causes the roulette rotor 46 to move from the waiting position above the sheet placing surface to the operating position (raking position) on the sheet placing surface for raking the sheet (St48). Then, the roulette rotor 46 is moved to the waiting position (position not contacting the sheet bundle) (St49), and the sheet bundle is aligned widthwise at the crimp-binding position Ep by the side aligning members 39F and 39R (St32), followed by lowering of the roulette rotor 46 from the waiting position above the sheet placing surface to the operating position (raking position) on the sheet placing surface (St33). At this time, both the paddle rotor 42 and roulette rotor 46 are rotated in the raking direction, i.e., a direction opposite to the sheet discharge direction for positioning the sheet bundle (FIG. 21C), and crimp-binding processing is performed by the crimp-binding unit 51 (St34, FIG. 21D). After that, the bound sheet bundle is moved downstream in the sheet conveying direction to complete sheet discharge operation (St35, FIG. 22).

The maximum number of sheets that can be shifted as a bundle can be replaced by a total count number a of the count numbers set for respective size of sheets. This allows optimum control for achieving good alignment performance when sheets having the same width but different height (small size: horizontal A4 and large size: vertical A3) are bound in a mixed manner. Specifically, with the count number of one small size sheet set to 60 and the count number of one large size sheet set to 120, and when the total count number of the sheets discharged onto the processing tray 37 reaches a predetermined value of 600, the sheets are moved in a bundle to the crimp-binding position Ep by the side aligning members 39F and 39R and, thereafter, the above-mentioned control (St38 and subsequent steps) for the large size sheet whose number exceeds a predetermined number of sheets is performed. For example, when nine A4 size (small size) sheet (i.e., count value: 540) and one A3 size (large size) (i.e., count value: 120) sheet are loaded in a mixed manner, the total count number is 660 (=540+120), so that at the point in time when this A3 sheet is received and raked, a bundle shifting operation is performed. Alternatively, at the point in time when information indicating that the sheet to be carried in onto the processing tray 37 is the A3 sheet, it is determined that the total count number exceeds 600, so that, in this case, the nine A4 sheets that have already been raked to the processing tray 37 are subjected to bundle shifting, followed by the one A3 sheet being discharged onto the processing tray 37 and then shifted.

Although the present embodiment is applied to the eco-binding mode, it can be applied not only to the eco-binding mode, but also to modes in which the sheet offset is performed, such as staple binding mode and other post-processing. Further, the shifting operation after the maximum number of sheets that can be shifted as a bundle is exceeded is performed for each sheet, which is effective for reliably raking the sheet with the paddle rotor 42 and roulette rotor 46 to enhance sheet alignment performance, while it is also possible to perform the shifting operation for every five or less sheets (e.g., two sheets) by increasing the drive force for the aligning plates or changing the inclination angle or shape of the processing tray.

[Operation at Time when Maximum Number of Sheets that can be Crimp-Bound is Exceeded/Canceling Operation]

Figure 23:
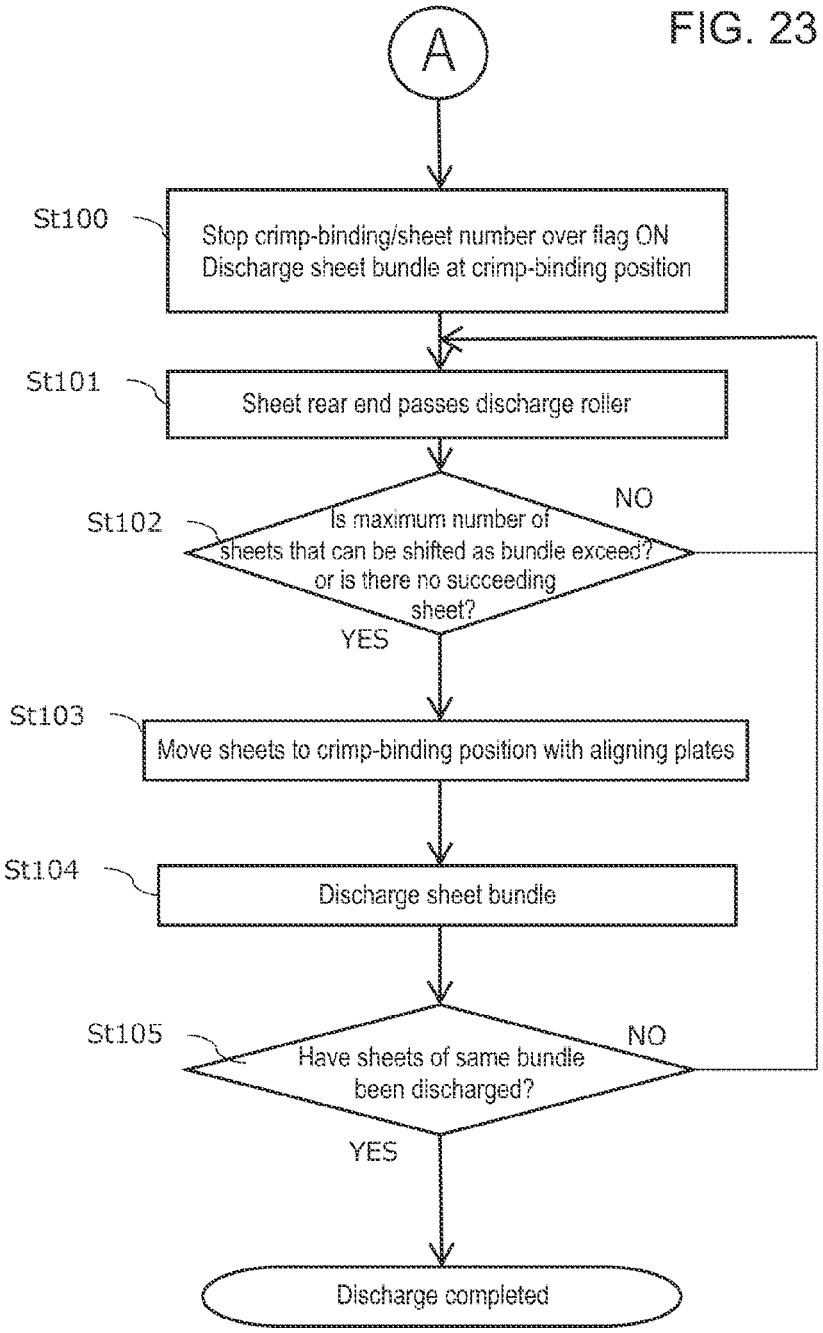
FIG. 23 is an operation flow when the number of sheets that can be crimp-bound is exceeded.

When a sheet is discharged to constitute a sheet bundle with sheets that have already been discharged onto the processing tray 37, and it has already been determined at this point in time that the maximum number of sheets that can be crimp-bound is exceeded (NO in St46 of the flowchart illustrated in FIGS. 13A and 13B), the crimp-binding processing is cancelled (shift to the flow illustrated in FIG. 23).

When the number of sheets stacked at the crimp-binding position exceeds the maximum number of sheets that can be crimp-bound, the crimp-binding processing by the crimp-binding unit 51 is not performed, but a canceling operation is carried out. In this canceling operation, at the point in time when the maximum number of sheets that can be crimp-bound is exceeded, the sheet bundle that has already been shifted to the crimp-binding position Ep is discharged to the stack tray 49 without being subjected to binding processing. After the discharge of the already shifted sheet bundle, the succeeding sheets that were to constitute the same sheet bundle are discharged after a shifting operation to be described later.

As described above, under the circumstances where the maximum number of sheets that can be crimp-bound is increased, there may be a case where the maximum number of sheets that can be crimp-bound exceeds the maximum number of sheets that can be shifted in a bundle, which causes sheets to be discharged to a plurality of different positions on the stack tray 49. In view of the above problem, a specific configuration according to the present invention will be described with a specific embodiment. There may be a case where the number of sheets constituting one sheet bundle exceeds the maximum number (in the present embodiment, 10) of sheets that can be crimp-bound. Specifically, for example, there may be a case where the number of documents read by the scanner unit A2 exceeds 10. In this case, the number of sheets constituting one sheet bundle is unclear at the stage when the reading is started, and thus the number of sheets constituting one sheet bundle may exceed the number of sheets that can be crimp-bound.

In the present embodiment, in a case where the number of sheets that have been shifted as a bundle to the crimp-binding position Ep reaches 10 that is the maximum number of sheets that can be crimp-bound and where there exists a succeeding sheet that is to constitute the bundle with the already shifted sheets, the crimp-binding processing by the crimp-binding unit 51 is not performed for the sheets located at the crimp-binding position Ep, but a crimp-binding canceling operation is performed to discharge the sheets outside the apparatus. The crimp-binding canceling operation will be described in detail below along the flowchart illustrated in FIG. 23.

When the succeeding sheet is conveyed from the image forming apparatus A to constitute one bundle in a state where the count value of the sheets at the crimp-binding position Ep is 10, the operation shifts to the crimp-binding canceling operation with carry-in of the succeeding sheet into the sheet post-processing apparatus B as a trigger (in response to a detection signal from the entrance sensor S1) (St46 in FIG. 13B and St100 in FIG. 23).

In the crimp-binding canceling operation, the sheet end regulating unit 38 (push-out projection 38) of the sheet post-processing apparatus B is moved to push out the sheet bundle (10 sheets) located at the crimp-binding position Ep toward the first stack tray 49. Subsequently, the elevating roller 41 is lowered to a pressure contact position to nip the sheet bundle together with the driven roller 48. In this state, the sheet bundle is fed to the exit of the processing tray 37 and discharged onto the stack tray 49 (St100). Such an operation is required because the frontage of the crimp-binding unit 51 is so narrow that it is difficult for the crimp-binding unit 51 to receive succeeding sheets. At this time, the sheet bundle is positioned at the crimp-binding position Ep that is at the apparatus rear side, so that the discharge position of the sheet bundle on the first stack tray 49 is offset to the apparatus rear side.

The succeeding 11-th and subsequent sheets are not subjected to the crimp-binding processing and are thus discharged from the position (center position) at which they have been discharged from the sheet discharge port 35 onto the processing tray 37, and in this state they are discharged to the first stack tray 49; however, the discharge position of this 11-th sheet and that of the preceding sheets that were to constitute the same sheet bundle become different, making it difficult for a user to take out the sheets. Further, it is inconvenient that the sheets are misaligned when they are staple-bound after being taken out. In view of this, in the present embodiment, the succeeding sheet is also shifted when being discharged, which will be described in detail below.

For the 11-th and subsequent sheets, which are not subjected to the crimp-binding processing, the following operation is performed. That is, each time the sheet is released from the sheet discharge roller 36 (St101), the elevating roller 41 and paddle rotor 42 are rotated to feed the sheet toward the sheet end regulating unit 38 so as to stack the sheet on the processing tray 37. Along with this operation, the side aligning members 39 are made to abut against both side edges of the sheet in the sheet width direction to align the sheet to the center in the width direction of the processing tray 37. When the number of the thus stacked sheets reaches the maximum number of sheets that can be shifted as a bundle, or when no succeeding sheet is present (St102), the sheets are shifted as a bundle to the crimp-binding position Ep of the crimp-binding unit 51 (St103). Then, the sheet end regulating unit 38 (push-out projection 38) is moved to push up the sheets at the crimp-binding unit 51 toward the exit of the processing tray 37. Subsequently, the elevating roller 41 is lowered to the pressure contact position to nip the sheet bundle together with the driven roller 48. In this state, the sheet bundle is fed to the exit of the processing tray 37 and discharged onto the stack tray 49 (St104).

The above control is performed for all the sheets constituting one sheet bundle. That is, stacking of the sheet discharged from the image forming apparatus A on the processing tray 37, bundle shift by the side edge aligning unit 39, and sheet discharge onto the stack tray 49 are performed in this order (St105).

In the bundle shifting operation of the succeeding sheets to the crimp-binding position Ep by the side edge aligning unit 39, the number of sheets to be shifted as a bundle may be any number that can be moved by the drive force of the above-described side edge aligning unit 39. Alternatively, the succeeding sheets may be shifted one by one each time of sheet discharge.

Further, the number of sheets to be shifted as a bundle may be determined based on a weighted count value considering the basis weight of the sheets to be shifted as a bundle, and the bundle shift is performed when the accumulated count value exceeds a predetermined value. This can avoid a moving failure due to insufficient drive force of the side edge aligning unit 39 at the time of bundle shifting.

In the present invention, the above operation is performed for the purpose of preventing the sheets from being discharged to different positions on the stack tray 49 when the number of sheets constituting one sheet bundle exceeds the maximum number of sheets that can be crimp-bound and thereby preventing usability from being impaired; on the other hand, there may be a case where a job in which binding is cancelled needs to be completed earlier (productivity is prioritized). In view of this, there may be provided a selecting unit for a user to select one of: a method in which sheets are shifted as a bundle to the crimp-binding position Ep after the number of sheets constituting one sheet bundle exceeds the maximum number of sheets that can be crimp-bound; and a method in which sheets are discharged from the center position, and whether to perform bundle shifting to the crimp-binding position Ep may be determined according to the selection result.

When the above-mentioned canceling operation is performed, it is made clear by the recognizing unit that the number of sheets constituting a succeeding sheet bundle in the same job exceeds the maximum number of sheets that can be crimp-bound, so that a sheet number over flag is ON (crimp-binding is cancelled for subsequent sheet bundles in the same job). In this case, it is preferable that sheets are discharged without bundle shift onto the stack tray 49 after center aligning.

As described above, according to the above embodiments, there can be provided a sheet processing apparatus in which sheets constituting one sheet bundle are prevented from being discharged to different positions on the first stack tray 49 even when the number of sheets constituting one sheet bundle exceeds the maximum number of sheets that can be crimp-bound.

It should be appreciated that the present invention is not limited to the above-mentioned embodiments, and various modifications may be made thereto. Further, all technical matters included in the technical ideas set forth in the claims should be covered by the present invention. While the invention has been described based on preferred embodiments, those skilled in the art can realize various substitutions, corrections, modifications, or improvements from the content disclosed in the specification, which are included in the scope defined by the appended claims.

This application claims priority from Japanese Patent Application No. 2020-208389 and Japanese Patent Application No. 2020-208390 incorporated herein by reference.

The invention claimed is:

1. A sheet processing apparatus comprising:

a conveying unit that conveys a sheet in a predetermined conveying direction;

a sheet placing part on which the sheet conveyed by the conveying unit is placed at a placing position;

an aligning unit that aligns the sheet placed at the placing position in a width direction intersecting the conveying direction and moves the sheet by a predetermined amount in the width direction to a shift position;

a recognizing unit that recognizes the length in the conveying direction and the number of sheets to be fed onto the placing part; and a controller that controls the aligning unit, wherein when the recognizing unit recognizes that the length of the sheets placed at the placing position is equal to or more than a predetermined length and that the number of sheets placed thereat is equal to or more than a predetermined number, the controller performs control such that: the aligning unit is made to perform an aligning operation each time one sheet is placed at the placing position; at the point in time when the number of sheets discharged onto the placing part reaches the predetermined number, the aligning unit is made to move the sheets as a bundle to the shift position after performing the sheet alignment at the discharge position; and when sheets constituting a sheet bundle together with the sheets that have already been moved to the shift position are fed onto the placing part after execution of the bundle shift, they are subjected to a single-sheet shifting operation to be moved to the shift position one by one after being conveyed onto the placing part.

2. The sheet processing apparatus according to claim 1, further comprising a raking unit that moves a sheet discharged onto the placing part upstream in the conveying direction to position the sheet at the placing part, wherein the raking unit includes a swing arm disposed so as to contact and separate from the sheet on the placing part and a rotary member mounted to the swing arm, and when the aligning unit moves the sheets one by one, the controller controls the raking unit such that the rotary member contacts and rakes the sheet.

3. The sheet processing apparatus according to claim 1, wherein the aligning unit is constituted by a pair of plate members configured to contact one side and the other side of a sheet in a width direction thereof, when moving a sheet bundle, both the plate members are moved while sandwiching the sheet bundle, and when moving sheets one by one to the shift position, one of the plate members is positioned at the shift position and, in this state, the other one of the plate members is moved toward the shift position to position the sheet at the shift position.

4. The sheet processing apparatus according to claim 1, further comprising a non-staple binding processing part that crimp-binds a sheet bundle, wherein the non-staple binding processing part performs binding processing for a sheet bundle located at the shift position.

5. The sheet processing apparatus according to claim 1, further comprising a raking unit provided above the placing part and configured to rake a sheet to the placing part in a direction parallel to the conveying direction, wherein the raking unit includes a raking controller that controls the raking unit so as to move between a waiting position separated from a sheet, a raking position for raking a sheet, and a position between the waiting position and the raking position at which the raking unit performs raking for the single-sheet shifting operation.

6. The sheet processing apparatus according to claim 1, wherein when a sheet is the last sheet in the single-sheet shifting operation, the raking controller performs sheet raking again after completion of the single-sheet shifting operation, and at the time of the raking, the controller controls the aligning unit to be separated from the sheet.

7. An image forming system having the sheet processing apparatus as claimed in claim 1.

8. A sheet processing apparatus comprising:

a conveying unit that conveys a sheet in a predetermined conveying direction;

a sheet placing part on which the sheet conveyed by the conveying unit is placed at a placing position;

an aligning unit that aligns the sheet placed at the placing position in a width direction intersecting the conveying direction and moves the sheet by a predetermined amount in the width direction to a shift position;

a recognizing unit that recognizes and counts a predetermined count value set for each size of the sheet to be fed onto the placing part; and a controller that controls the aligning unit so as to align sheets discharged to the placing part each time one sheet is placed on the placing part and so as to, when it is determined as a result, obtained by the recognizing unit, of counting the count value of the sheets placed on the placing part that a predetermined total count value is exceeded by addition of the count value of a succeeding sheet to be placed on the placing part next, move a sheet bundle that has already been placed on the placing part to the shift position and perform a single-sheet shifting operation to move one by one succeeding sheets placed on the placing part to the shift position.

9. An image forming system having the sheet processing apparatus as claimed in claim 8.

10. A sheet processing apparatus comprising:

a conveying unit that conveys a sheet in a predetermined conveying direction;

a sheet placing part on which the sheet conveyed by the conveying unit is placed at a placing position;

an aligning unit that aligns the sheet placed at the placing position in a width direction intersecting the conveying direction and moves the sheet by a predetermined amount in the width direction to a shift position;

a recognizing unit that recognizes a predetermined count value set for each size of the sheets paced at the placing part; and a controller that controls the aligning unit so as to align sheets at the placing part each time one sheet is placed on the placing part and so as to, when it is determined as a result, obtained by the recognizing unit, of counting the count value of the sheets placed on the placing part that the number of the sheets placed on the placing part exceeds a predetermined count value, move a sheet bundle that has already been placed on the placing part to the shift position and move one by one succeeding sheets placed on the placing part to the shift position.

11. An image forming system having the sheet processing apparatus as claimed in claim 10.

12. A sheet processing apparatus comprising:

a conveying unit that conveys a sheet in a predetermined conveying direction;

a sheet placing part on which the sheet conveyed by the conveying unit is placed;

an aligning unit that aligns the sheet placed at a placing position of the placing part in a sheet width direction along a sheet surface intersecting the conveying direction;

a moving unit that moves the sheet placed at the placing position of the placing part in the sheet width direction along the sheet surface intersecting the conveying direction to a shift position;

a recognizing unit that recognizes the size and number-of-sheets information of sheets fed to the placing part; and a controller that controls the aligning unit and moving unit, wherein the controller performs control such that: when the recognizing unit recognizes that a sheet placed on the placing part is a small size sheet having a length in the conveying direction equal to or less than a predetermined length, the sheet placed on the placing part is subjected to an alignment operation by the aligning unit at a position to which the sheet is discharged until the number of sheets placed on the placing part reaches a predetermined number, followed by sheet movement to the shift position by the moving unit; and when the recognizing unit recognizes that a sheet placed on the placing part is a large size sheet having a length in the conveying direction exceeding a predetermined length, the aligning unit performs sheet aligning at the point in time when the number of sheets placed on the placing part does not yet reach the predetermined number, followed by sheet movement to the shift position by the moving unit, and sheets conveyed to the placing part by the conveying unit are moved one by one to the shift position.

13. An image forming system having the sheet processing apparatus as claimed in claim 12.

* * * * *